US007822364B2

(12) United States Patent
Takigawa et al.

(10) Patent No.: US 7,822,364 B2
(45) Date of Patent: Oct. 26, 2010

(54) IMAGE FORMING APPARATUS

(75) Inventors: Junya Takigawa, Tokyo (JP); Yoshimi Asayama, Mie (JP)

(73) Assignee: Ricoh Company, Limited, Tokyo (JP)

( * ) Notice: Subject to any disclaimer, the term of this patent is extended or adjusted under 35 U.S.C. 154(b) by 104 days.

(21) Appl. No.: 12/219,281

(22) Filed: Jul. 18, 2008

(65) Prior Publication Data

US 2009/0028597 A1 Jan. 29, 2009

(30) Foreign Application Priority Data

Jul. 23, 2007 (JP) ..... 2007-190751

(51) Int. Cl.
*G03G 15/20* (2006.01)

(52) U.S. Cl. ..... 399/167; 399/111

(58) Field of Classification Search ..... 399/111, 399/116, 167

See application file for complete search history.

(56) References Cited

U.S. PATENT DOCUMENTS 7,366,443 B2 * 4/2008 Ohashi et al. ..... 399/167

FOREIGN PATENT DOCUMENTS

JP 2004-045603 2/2004
JP 2005-017758 1/2005
JP 2006-048014 2/2006
JP 2006-072160 3/2006
JP 2006-106681 4/2006
JP 2007-286575 11/2007

* cited by examiner

*Primary Examiner*—Hoang Ngo
(74) *Attorney, Agent, or Firm*—Harness, Dickey & Pierce, P.L.C.

(57) ABSTRACT

An image forming apparatus includes an apparatus main-body and a process cartridge. A female connector is arranged on a developing roller shaft in the process cartridge. The female connector has an open-ended ring-like space formed between an outer ring and an inner ring. A plurality of track grooves are arranged on the circumference of at least one of the outer ring and the inner ring. One end of a cartridge driving shaft is supported in the apparatus main-body, while the other end thereof facing the process cartridge is movable in a radial direction. A male connector is arranged on the movable end of the cartridge driving shaft. A front portion of the male connector is a cylindrical spherical-body holding portion that rotatably holds a plurality of spherical bodies. When the spherical-body holding portion enters into the ring-like space, the spherical bodies slide along the track grooves.

12 Claims, 20 Drawing Sheets

IMAGE FORMING APPARATUS

CROSS-REFERENCE TO RELATED APPLICATIONS

The present application claims priority to and incorporates by reference the entire contents of Japanese priority document, 2007-190751 filed in Japan on Jul. 23, 2007.

BACKGROUND OF THE INVENTION

1. Field of the Invention

The present invention relates to an image forming apparatus having a detachable processing unit.

2. Description of the Related Art

An electrophotographic image forming apparatus includes an image carrying member on which an electrostatic latent image is formed. The electrostatic latent image is then developed by using a developer and transferred on a recording medium. In some image forming apparatuses, a process cartridge is detachably installed in a main body of the image forming apparatus (hereinafter, "apparatus main-body"). Such a process cartridge includes in a cartridge housing a photosensitive drum, which is an image carrying member, and one or more processing units such as a charging unit, a developing unit, and a cleaning unit arranged around the photosensitive drum.

FIG. 18 is a schematic diagram of a situation in which a process cartridge 201 is detached from a conventional apparatus main-body. FIG. 19 is a schematic diagram of a situation in which the process cartridge 201 is installed in the apparatus main-body.

The process cartridge 201 includes a photosensitive drum 202 and a developing unit 205 as a driven unit. A rear flange 202*b* of the photosensitive drum 202 has a rear drum-shaft hole (not shown). A concave gear 221 with a conical pitch surface is arranged on the outer surface of the rear flange 202*b* around the rear drum-shaft hole. A front flange 202*c* of the photosensitive drum 2 has a front drum-shaft hole 202*e* at the center. A cartridge rear plate 211 is arranged on one side and a cartridge front plate 218 is arranged on the other side of the photosensitive drum 202 along the axial direction. The photosensitive drum 202 is rotatably supported on the cartridge rear plate 211 and the cartridge front plate 218. The position of the photosensitive drum 202 is not determined when the process cartridge 201 is in a detached state. The developing unit 205 includes a developing roller 205*g*, a developing roller gear 258, an idler shaft 259, and a driven gear 260. The developing roller 205*g* is supported on the cartridge rear plate 211 and the cartridge front plate 218. The idler shaft 259 is fixed to the cartridge rear plate 211. The driven gear 260 is rotatably arranged on the idler shaft 259 and drives the developing roller 205*g*.

The cartridge rear plate 211 has an engagement slot 270. A support bearing 271 is arranged on the cartridge front plate 218.

The apparatus main-body includes a main-body plate front 225 and a main-body rear plate 291. A supporting plate 289 is fixed to the main-body rear plate 291. A drum driving motor 281 is arranged on the supporting plate 289. A drum shaft 202*a* is rotatably fixed to the supporting plate 289 via a support bearing 290. When the process cartridge 201 is installed in the apparatus main-body, the drum shaft 202*a* passes through the photosensitive drum 202 in the axial direction. A coupling mechanism 293 linearly couples the drum shaft 202*a* with a drum motor shaft 281*a* of the drum driving motor 281. A first pulley 286, a convex gear 220 with a conical pitch surface, and a support bearing 215 are fixed to the drum shaft 202*a*.

A cartridge driving shaft 282 is rotatably fixed to the main-body rear plate 291 and the supporting plate 289 via support bearings 284*a* and 284*b*, respectively (two-point support configuration). A second pulley 283 is fixed to the cartridge driving shaft 282. A timing belt 285 is stretched around the first pulley 286 and the second pulley 283. A driving gear 262 is fixed to a front end of the cartridge driving shaft 282 facing the process cartridge 201. A support bearing 226 is fixed to the main-body front plate 225 for supporting the front end of the drum shaft 202*a*.

When the process cartridge 201 is installed in the apparatus main-body by opening the main-body front plate 225, the drum shaft 202*a* passes through the photosensitive drum 202 and the concave gear 221 engages with the convex gear 220 (see FIG. 19). In this way, the position of the photosensitive drum 202 with respect to the apparatus main-body is determined. At the same time, the engagement slot 270 engages with the support bearing 215 such that the position of the process cartridge 201 with respect to the apparatus main-body is also determined. Moreover, the driven gear 260 engages with the driving gear 262.

As described above, the idler shaft 259, on which the driven gear 260 is arranged for driving the developing roller 205*g*, is fixed to the cartridge rear plate 211 in the process cartridge 201; while the cartridge driving shaft 282, on which the driving gear 262 is arranged for driving the driven gear 260, is rotatably fixed to the main-body rear plate 291 in the apparatus main-body. Thus, if the position of the process cartridge 201 with respect to the apparatus main-body is determined based on the drum shaft 202*a*, accumulation of the positioning tolerance may result in distance fluctuation between the shaft centers of the idler shaft 259 and the cartridge driving shaft 282. As a result, vibrations are generated when the driven gear 260 engages with the driving gear 262 to receive the driving force. Those vibrations reach the photosensitive drum 2 and result in a traverse stripe effect in an image formed thereon.

Japanese Patent Application Laid-open No. 2004-45603 discloses a coupling mechanism for coupling a driven shaft and a driving shaft. Even if the centers of the driving shaft and the driven shaft are out of alignment, the coupling mechanism enables the transmission of a driving force from the driving shaft to the driven shaft without the occurrence of vibrations.

FIGS. 20A to 20C are explanatory diagrams of a coupling mechanism 316 disclosed in Japanese Patent Application Laid-open No. 2004-45603. As shown in FIG. 20A, a driven shaft 315 is shown uncoupled with a driving shaft 320. As shown in FIG. 20B, the driven shaft 315 is shown coupled with the driving shaft 320 via the coupling mechanism 316. FIG. 20C is a view of the coupling mechanism 316 when viewed from the driving shaft 320.

The coupling mechanism 316 includes a tubular first coupling portion 319 in which the driven shaft 315 fits and a second coupling portion 318 in which the driving shaft 320 fits. The first coupling portion 319 has an elongate guide hole W. When the driven shaft 315 enters into the first coupling portion 319, a slide pin 331 passes through the guide hole W and fits in a though hole (not shown), which is close to the front end of the driven shaft 315 facing the driving shaft 320 and in alignment with the guide hole W. In this way, the driven shaft 315 fits in the coupling mechanism 316.

A spring bearing 332 is fixed to the driven shaft 315. A coil spring 317 is arranged between the spring bearing 332 and the coupling mechanism 316 such that the coupling mechanism 316 is maintained biased towards the driven shaft 315.

An internal diameter 'a' of the first coupling portion 319 is bigger than a diameter 'b' of the driven shaft 315. Thus, the driven shaft 315 fits in the coupling mechanism 316 with a clearance distance Q therebetween. Such a configuration enables the coupling mechanism 316 to oscillate around the slide pin 331.

The second coupling portion 318 is a cup-like portion having two protruded members V that face each other and protrude towards the axis of the driving shaft 320 (see FIG. 20C). A driving pin 330 is fit in a through hole (not shown) close to the front end of the driving shaft 320 facing the driven shaft 315. The sides of the driving pin 330 protrude from the driving shaft 320 with a phase difference of 180°.

When the shaft centers of the driving shaft 320 and the driven shaft 315 are out of alignment, the driving pin 330 may not be able to enter into the second coupling portion 318. In that case, the coupling mechanism 316 oscillates around the slide pin 331 and rests in a tilted position with respect to the driven shaft 315. That enables the driving pin 330 to enter into the second coupling portion 318 and engage with a surface Va of the protruded members V. Thus, even if the shaft centers of the driving shaft 320 and the driven shaft 315 are out of alignment, the driving force is transmitted from the driving shaft 320 to the driven shaft 315 without the occurrence of vibrations. As a result, the image quality can be maintained by preventing a traverse stripe effect in an image.

Although the driving pin 330 can enter into the second coupling portion 318 when the shaft centers of the driving shaft 320 and the driven shaft 315 are out of alignment, only one side of the driving pin 330 engages at a time with one of the protruding members V (see FIG. 21A). As the driving shaft 320 rotates, a tip of the other side of the driving pin 330 engages with the other protruding member V (see FIG. 21B). As the driving shaft 320 keeps rotating, the engagement position on the protruding members V gradually shifts from the tip of the driving pin 330 towards the driving shaft 320. The circumferential speed at the tip of the driving pin 330 is higher than the circumferential speed at a position close to the driving shaft 320. Consequently, the rotating speed transmitted to the coupling mechanism 316 is higher when the tip of the driving pin 330 engages with the protruded member V (see FIG. 21A) than when a position close to the driving shaft 320 engages with the protruded member V (see FIG. 21B). As a result, the rotating speed of the developing roller 205*g* fluctuates thereby varying the image density in an image. The variation in the image density occurs because when the rotating speed of the developing roller 205*g* is low, less amount of developer is coated on the photosensitive drum 202. On the other hand, when the rotating speed of the developing roller 205*g* is high, more amount of developer is coated on the photosensitive drum 202.

To solve such a problem, a coupling mechanism 390 is implemented to couple the driven shaft 315 with the driving shaft 320 (see FIG. 22). The coupling mechanism 390 includes a coupling joint 391 and a tilt angle negating unit 392. The driving shaft 320 is fixed to the main-body rear plate 291 via a support bearing 292 (one-point support). In that case, the fixed position of the driving shaft 320 is maintained at more than a predetermined distance from the front end of the driving shaft 320. Such one-point support configuration allows the driving shaft 320 to easily move in a radial direction around the fixed position on the main-body rear plate 291 as compared to the two-point support configuration shown in FIG. 18.

The coupling mechanism 390 includes a driven-shaft coupling member 349, a driving-shaft coupling member 350, a leaf spring 360, and a driven-shaft fixing member 370. The driven-shaft coupling member 349 engages with the driving-shaft coupling member 350 to form the coupling joint 391. The leaf spring 360 is fixed between the driven-shaft coupling member 349 and the driven-shaft fixing member 370 by using bolts and the like to form the tilt angle negating unit 392.

When the shaft centers of the driving shaft 320 and the driven shaft 315 are out of alignment, the front end of the driving shaft 320 tilts in the radial direction and gets coupled with the driven shaft 315.

In that case, the transmission of torque through the coupled portion of the driven-shaft coupling member 349 and the driving-shaft coupling member 350 undergoes fluctuation by one rotational period. That fluctuation affects the operating speed of a driving motor (not shown), which is the driving source for the driving shaft 320, and in turn fluctuates the rotating speed of the developing roller 205*g*. As a result, the image density in an image varies. To avoid such a problem, it is necessary to negate the effect of the torque fluctuation. That can be achieved by using the tilt angle negating unit 392 in which the leaf spring 360 bends to negate the effect of the torque fluctuation. Thus, the driven shaft 315 rotates at a constant speed at which the driving shaft 320 rotates.

However, because the coupling joint 391 and the tilt angle negating unit 392 are arranged at different locations along the axial direction, the coupling mechanism 390 inevitably becomes larger in along the axial direction. That affects the compactness of the image forming apparatus. Moreover, the configuration becomes complicated because of the presence of the coupling joint 391 and the tilt angle negating unit 392 as separate parts. As a result, the manufacturing cost of the image forming apparatus increases.

SUMMARY OF THE INVENTION

It is an object of the present invention to at least partially solve the problems in the conventional technology.

According to an aspect of the present invention, there is provided an image forming apparatus including an apparatus main-body that includes a rotatable driving shaft rotated by a driving force of a driving source; a processing unit that includes a rotatable driven shaft and a rotating member arranged on the driven shaft and that is configured to be detachably installed in the apparatus main-body; a coupling mechanism that couples the driving shaft to the driven shaft, the coupling mechanism including a male connector being fixed on either one of the driving shaft and the driven shaft and a female connector being fixed on either one of the driving shaft and the driven shaft on which the male connector is not fixed; and a positioning mechanism that, when the processing unit is installed in the apparatus main-body, performs positioning of the processing unit with respect to the apparatus main-body, the positioning mechanism including a first positioning member in the apparatus main-body and a second positioning member in the processing unit and the first positioning member engages with the second positioning member when the processing unit is installed in the apparatus main-body thereby performing positioning of the processing unit with respect to the apparatus main-body. An end of the driving shaft facing the processing unit is movable in directions orthogonal to the driving shaft, the female connector has an external wall and an internal wall forming therebetween an open-ended ring-like space, and includes a plurality of grooves that run in a direction of depth of the ring-like space on at least one of the external wall and the internal wall, the male connector includes a plurality of spherical bodies that, upon entering into the ring-like space, slide along the track grooves. When the processing unit is installed in the apparatus main-body, the male connector is coupled with the female connector by inserting the spherical bodies in the ring-like space.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

Figure 1:
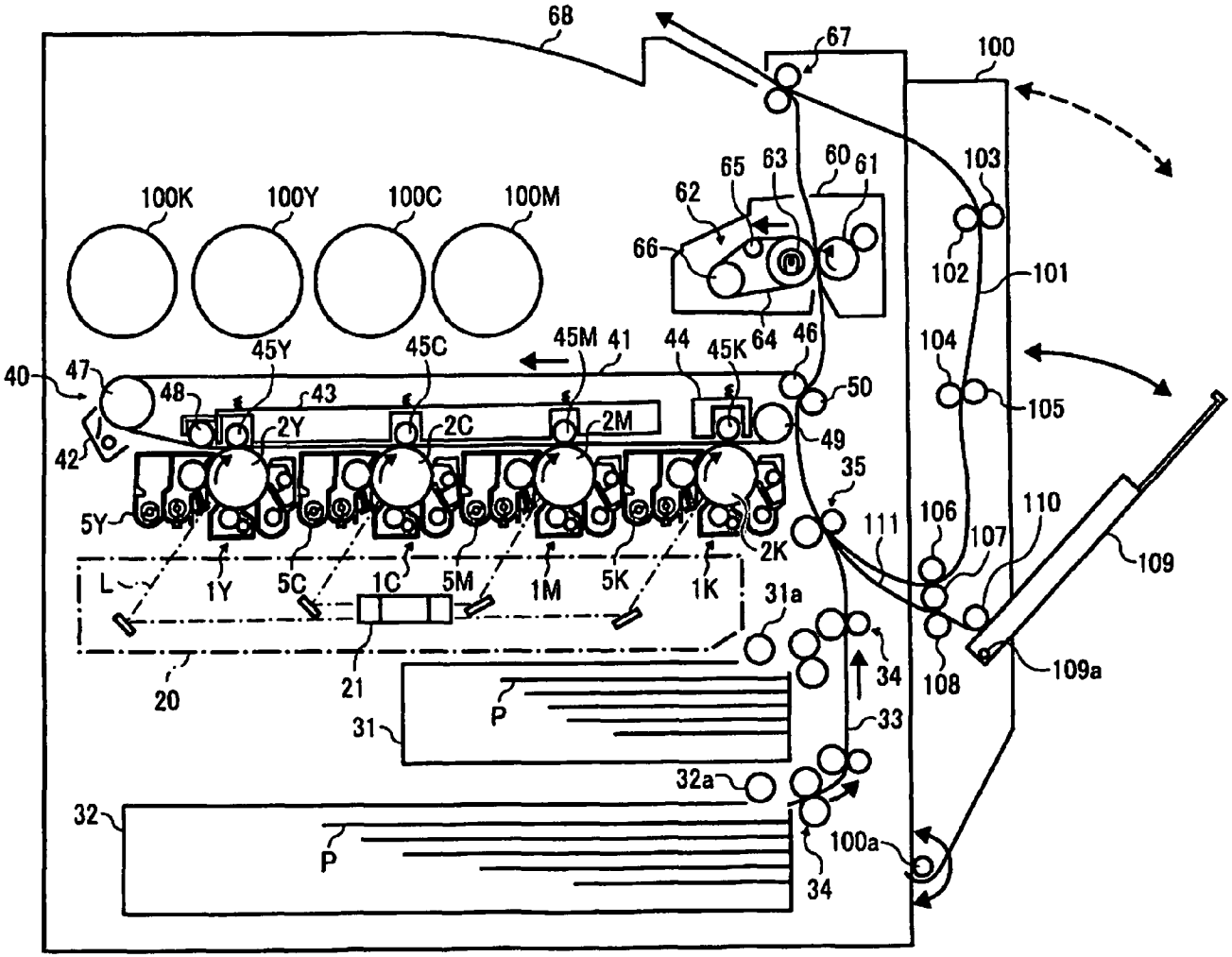
FIG. 1 is a schematic diagram of an image forming apparatus according to an embodiment of the present invention.

FIG. 1 is a schematic diagram of an image forming apparatus (e.g., an electrophotographic printer) according to an embodiment of the present invention. The image forming apparatus includes four process cartridges 1Y, 1C, 1M, and 1K, each of which forms a toner image in yellow, cyan, magenta, and black, respectively. Except for the color of toner, each of the process cartridges 1Y, 1C, 1M, and 1K have an identical structure and can be suitably replaced upon wear and tear. Hence, for simplification, the structure and the functioning of the process cartridges 1Y, 1C, 1M, and 1K is described with reference to a single process cartridge 1 without considering the color of toner.

Figure 2:
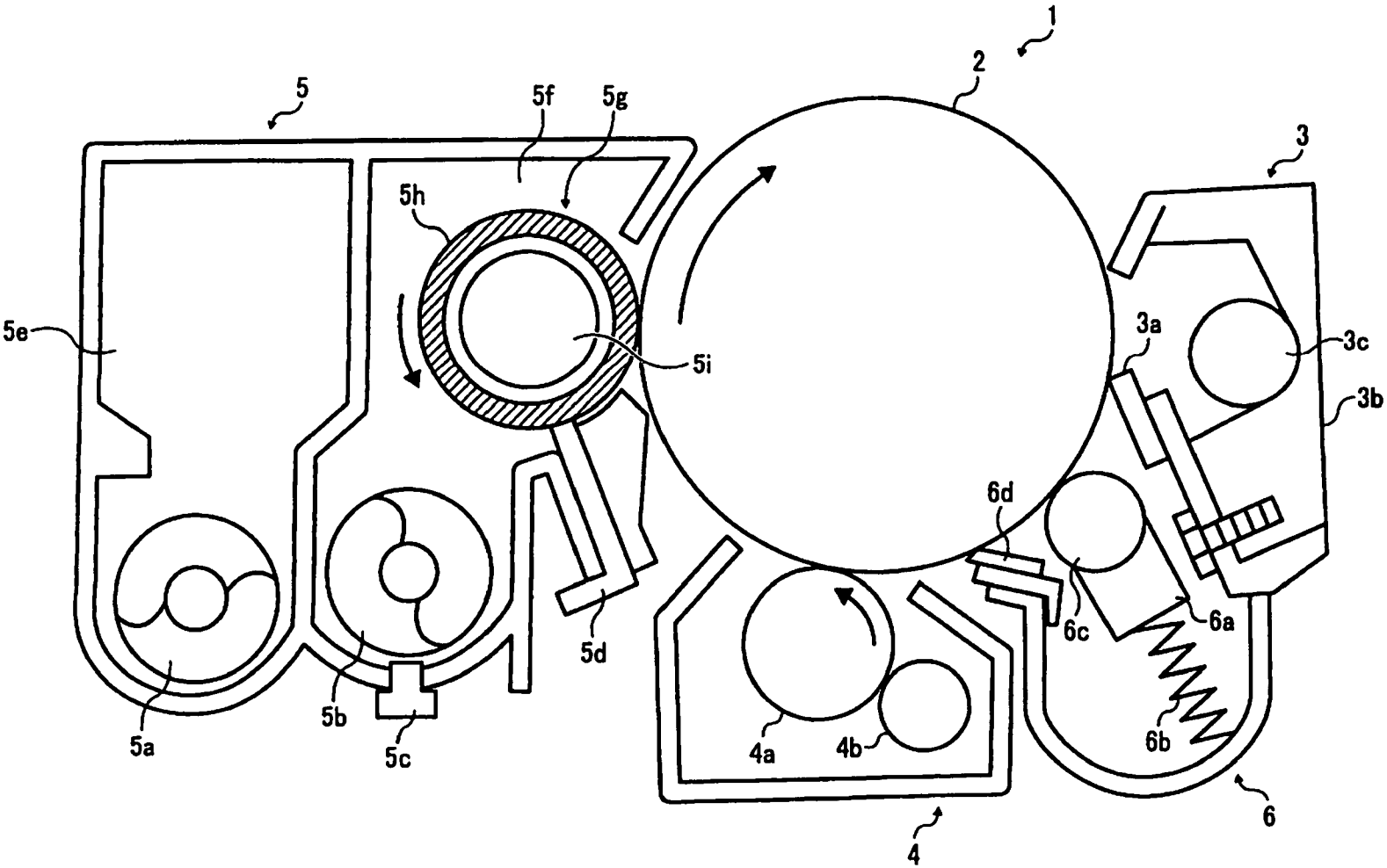
FIG. 2 is an enlarged view of a process cartridge in the image forming apparatus.

FIG. 2 is an enlarged view of the process cartridge 1. The process cartridge 1 includes in a cartridge housing (not shown) a photosensitive drum 2, which is an image carrying member, a drum-cleaning unit 3, a charging unit 4, a developing unit 5, and a lubricant coating mechanism 6. The process cartridge 1 is detachably installed in an apparatus main-body and can be suitably replaced upon wear and tear.

When a driving unit (not shown) rotates the photosensitive drum 2 in the clockwise direction, the charging unit 4 uniformly charges the surface of the photosensitive drum 2 by using a non-contact charging system. More particularly, the charging unit 4 includes a charging roller 4*a* that rotates in the anticlockwise direction and is arranged close to the photosensitive drum 2 in a non-contact manner. A charge bias voltage is applied to the charging roller 4*a* to uniformly charge the surface of the photosensitive drum 2. The photosensitive drum 2 can also be charged by using a scorotron charging system, a corotron charging system, or a contact charging system.

In the case of the contact charging system and the non-contact charging system, the charging roller 4*a* charges the photosensitive drum 2 by using alternate current (AC) superimposition charging or direct current (DC) charging. When the AC-superimposition charging is performed in the contact charging system, the alternating current is subjected to constant current control. Thus, the surface potential of the charging roller 4*a* remains unaffected by the fluctuation in the resistance value thereof due to environmental changes. However, such a configuration is costly because it needs an appropriate power supply unit. Moreover, the noise generated due to the high-frequency alternating current also becomes a problem. On the other hand, when the AC-superimposition charging is performed in the non-contact charging system, because the gap between the photosensitive drum 2 and the charging roller 4*a* can vary, the surface of the photosensitive drum 2 may not be uniformly charged and the image quality could degrade. To solve such a problem, it becomes necessary to arrange a charge bias correcting unit compatible to the gap variation.

To rotate the charging roller 4*a*, the driving force of the driving unit, which is used to rotate the photosensitive drum 2, can be transmitted to the charging roller 4*a* directly or via a gear. Usually, in the case of a low-speed image forming apparatus, the charging roller 4*a* is configured to directly receive the driving force and rotate along with the photosensitive drum 2. On the other hand, in the case of a high-speed high-quality image forming apparatus, the charging roller 4*a* is configured to receive the driving force via a gear.

The charging unit 4 also includes a cleaning roller 4*b* that cleans the surface of the charging roller 4*a* and facilitates uniformly charging the surface of the photosensitive drum 2 to a predetermined electric potential. Thus, it becomes possible to maintain the image quality. The cleaning roller 4*b* is made of melanin and rotates along with the charging roller 4*a*.

The developing unit 5 includes a first developer container 5*e* and a second developer container 5*f*. A first screw conveyer 5*a* is arranged in the first developer container 5*e*. A second screw conveyer 5*b*, a magnetic permeability sensor 5*c*, a doctor blade 5*d*, and a developing roller 5*g* are arranged in the second developer container 5*f*. The first developer container 5*e* and the second developer container 5*f* contain a developer made of magnetic carrier particles and a negatively charged toner. The first screw conveyer 5*a* is rotated by a driving unit (not shown) and conveys the container in the first developer container 5*e* from the near side to the farther side. The developer then enters into the second developer container 5*f* via a through hole (not shown) in a partition between the first developer container 5*e* and the second developer container 5*f*. The second screw conveyer 5*b* is rotated by a driving unit (not shown) and carries the container in the second developer container 5*f* from the farther side to the near side. The magnetic permeability sensor 5*c* is arranged at the bottom of the second developer container 5*f* and detects the magnetic permeability of the developer to obtain the toner concentration in the developer. The developing roller 5*g* is arranged in the top portion of the second developer container 5*f* and has a parallel orientation to the second screw conveyer 5*b*. The developing roller 5*g* includes a developing sleeve 5*h* that rotates in the anticlockwise direction. A magnet roller 5*i* inside the developing sleeve 5*h* generates magnetic energy, because of which the developer in the second developer container 5*f* is pumped on the surface of the developing sleeve 5*h*. The doctor blade 5*d* is arranged at a predetermined distance from the developing sleeve 5*h* such that the developer coat on the developing sleeve 5*h* is maintained at a constant thickness. The developer is then conveyed to a developing area facing the photosensitive drum 2 and the toner in the developer is transferred on an electrostatic latent image formed on the surface of the photosensitive drum 2. As a result, a toner image is formed on the photosensitive drum 2. After transferring the toner on the photosensitive drum 2, the toner concentration in the developer decreases. The developer with decreased toner concentration is then returned to the second screw conveyer 5*b* by the rotation of the developing sleeve 5*h*. Upon reaching the front side in the second screw conveyer 5*b*, the developer is conveyed to the first developer container 5*e* via a through hole (not shown).

The magnetic permeability sensor 5*c* outputs the magnetic permeability of the developer to a control unit (not shown) in the form of a voltage signal. Because the magnetic permeability is correlated to the toner concentration in the developer, the output voltage from the magnetic permeability sensor 5*c* corresponds to the toner concentration. The control unit compares the output voltage with a reference voltage Vtref, which is stored in an random access memory (RAM) arranged therein, and corresponding to the amount of decrease in the toner concentration, instructs a toner supplying apparatus (not shown) to supply the toner to the developer in the first developer container 5*e*. In this way, the toner concentration in the developer is maintained within a predetermined range.

Meanwhile, after the toner image on the photosensitive drum 2 is transferred on a recording medium, the drum-cleaning unit 3 removes the residual toner from the photosensitive drum 2. The drum-cleaning unit 3 includes a cleaning blade 3*a* and a residual toner collecting member 3*b*. The cleaning blade 3*a* abuts against the surface of the photosensitive drum 2 and cleans the residual toner therefrom. The removed residual toner is collected in the residual toner collecting member 3*b*. A carrying auger 3*c* in the residual toner collecting member 3*b* then carries the residual toner to a residual toner bottle.

A serviceman can be asked to collect the residual toner stored in the residual toner bottle. However, the image forming apparatus can be configured such that the residual toner in the residual toner collecting member 3*b* is carried to the developing unit 5 for reuse in developing an electrostatic latent image.

The lubricant coating mechanism 6 applies a solid lubricant 6*a* to the surface of the photosensitive drum 2 so as to lower the coefficient of friction of the photosensitive drum 2. The lubricant coating mechanism 6 includes a pressure spring 6*b*, a fur brush roller 6*c*, and a lubricant coating blade 6*d*. Upon being rotated by the pressure spring 6*b*, the fur brush roller 6*c* scrapes the lubricant 6*a* and applies it to the surface of the photosensitive drum 2. Usually, zinc stearate (ZnSt) powder is used as the lubricant 6*a*. The fur brush roller 6*c* is made of insulating polyethylene terephthalate (PET), conductive PET, or acrylic fiber. The lubricant coating blade 6*d* ensures that the lubricant 6*a* applied on the surface of the photosensitive drum 2 is of uniform thickness. By applying the lubricant 6*a*, toner filming on the surface of the photosensitive drum 2 can be prevented.

As shown in FIG. 1, an optical writing unit 20 is arranged beneath the process cartridges 1Y, 1C, 1M, and 1K. The optical writing unit 20 delivers a laser light L, which is generated by a light source (not shown) based on image information, on each of the process cartridges 1Y, 1C, 1M, and 1K. As a result, an electrostatic latent image is formed on each of the process cartridges 1Y, 1C, 1M, and 1K. More particularly, in the optical writing unit 20, the laser light L deflects from a polygon mirror 21 and passes through a plurality of lenses and mirrors before falling on each of the process cartridges 1Y, 1C, 1M, and 1K.

A first feeding cassette 31 and a second feeding cassette 32 are arranged beneath the optical writing unit 20. The first feeding cassette 31 is arranged above the second feeding cassette 32. One or more sheets of a recording medium P (hereinafter, "sheets P") are stacked in the first feeding cassette 31 and the second feeding cassette 32. A first feeding roller 31*a* abuts against the topmost sheet P of the sheet stack in the first feeding cassette 31, while a second feeding roller 32*a* abuts against the topmost sheet P of the sheet stack in the second feeding cassette 32. When the first feeding roller 31*a* is rotated in the anticlockwise direction by a driving unit (not shown), the topmost sheet P in the first feeding cassette 31 is fed to a sheet conveying path 33, which extends vertically on the right side of the first feeding cassette 31. Similarly, when the second feeding roller 32*a* is rotated in the anticlockwise direction by a driving unit (not shown), the topmost sheet P in the second feeding cassette 32 is fed to the sheet conveying path 33. A plurality of pairs of rollers 34 are arranged along the sheet conveying path 33. The sheet P fed from either one of the first feeding cassette 31 and the second feeding cassette 32 is nipped between the pairs of rollers 34 and conveyed upward to a pair of registration rollers 35.

The pair of registration rollers 35 is arranged at the top end of the sheet conveying path 33. Upon reaching the pair of registration rollers 35, the conveyance of the sheet P comes to a temporary halt because the pair of registration rollers 35 is in a still state. Subsequently, the pair of registration rollers starts rotating at an appropriate timing such that the sheet P is conveyed to a secondary transfer nip formed between a secondary transfer roller 50 and a secondary-transfer backup roller 46.

An intermediate transfer unit 40 is arranged above the process cartridges 1Y, 1C, 1M, and 1K. The intermediate transfer unit 40 includes an intermediate transfer belt 41, which is an endless belt stretched around eight rollers, viz., four primary transfer rollers 45Y, 45C, 45M, and 45K, the secondary-transfer backup roller 46, a driving roller 47, an auxiliary roller 48, and a tension roller 49. Moreover, the intermediate transfer belt 41 rotates in the anticlockwise direction along with the rotation of the driving roller 47. The intermediate transfer unit 40 also includes a belt-cleaning unit 42, a first bracket 43, and a second bracket 44. Each of the primary transfer rollers 45Y, 45C, 45M, and 45K abuts against a corresponding photosensitive drum 2Y, 2C, 2M, and 2K, respectively, across the intermediate transfer belt 41 to form four primary transfer nips. A transfer bias voltage is applied to the inside of the intermediate transfer belt. The polarity of the toner bias voltage is opposite to that of the toners in the process cartridges 1Y, 1C, 1M, and 1K. At each primary transfer nip, a single-color toner image in yellow, cyan, magenta, and black, respectively, is sequentially primary-transferred on an identical area on the outer surface of the intermediate transfer belt 41. That is, the four single-color toner images are superimposed on the outer surface of the intermediate transfer belt 41 to form a four-color toner image.

The pair of registration rollers 35 conveys the sheet P to the secondary transfer nip at the same timing when the full-color toner image formed on the intermediate transfer belt 41 reaches the secondary transfer nip. A secondary transfer bias voltage is applied to the secondary transfer roller 50 and the secondary-transfer backup roller 46 such that an electric field is generated around the secondary transfer nip. Because of the electric field and the nip pressure of the secondary transfer nip, the four-color toner image is batch transferred on the sheet P while being conveyed through the secondary transfer nip. The four-color toner image and the white color of the sheet P results in formation of a full-color toner image on the sheet P.

After the four-color toner image is transferred on the sheet P, the belt-cleaning unit 42 removes the residual toner from the intermediate transfer belt 41.

A fixing unit 60 is arranged above the secondary transfer nip, and includes a pressure roller 61 and a fixing belt mechanism 62. The fixing belt mechanism 62 includes a fixing belt. 64, which is an endless belt stretched around a heating roller 63, a tension roller 65, and a driving roller 66. The fixing belt 64 rotates in the anticlockwise direction. The heating roller 63 includes a heat source (not shown) such as a halogen lamp for applying heat to the fixing belt 64 from behind. The pressure roller 61 abuts against the heating roller 63 across the fixing belt 64 to form a fixing nip.

After passing through the second transfer nip, the sheet P with a full-color toner image thereon reaches the fixing unit 60. The full-color toner image is fixed on the sheet P while being conveyed through the fixing nip.

The sheet P is then discharged to a catch tray 68 via a pair of discharge rollers 67. The catch tray 68 is arranged on the top surface of a main-body housing.

Four toner cartridges 100Y, 100C, 100M, and 110K are arranged above the intermediate transfer unit 40 for supplying a corresponding toner to each developing unit 5Y, 5C, 5M, and 5K, respectively.

As described above, a toner image is formed on the sheet P by using the process cartridges 1Y, 1C, 1M, and 1K, the optical writing unit 20, and the intermediate transfer unit 40.

Figure 3A:
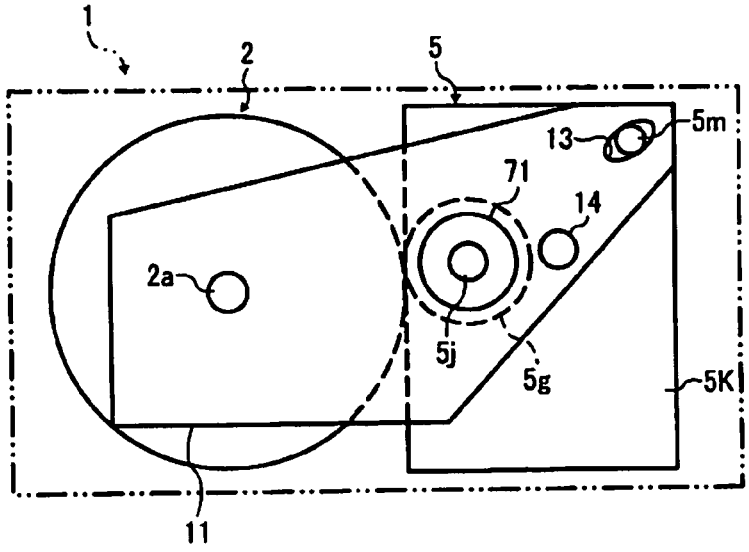
FIG. 3A is a front view of the process cartridge when viewed from the rear side of an apparatus main-body.
Figure 3B:
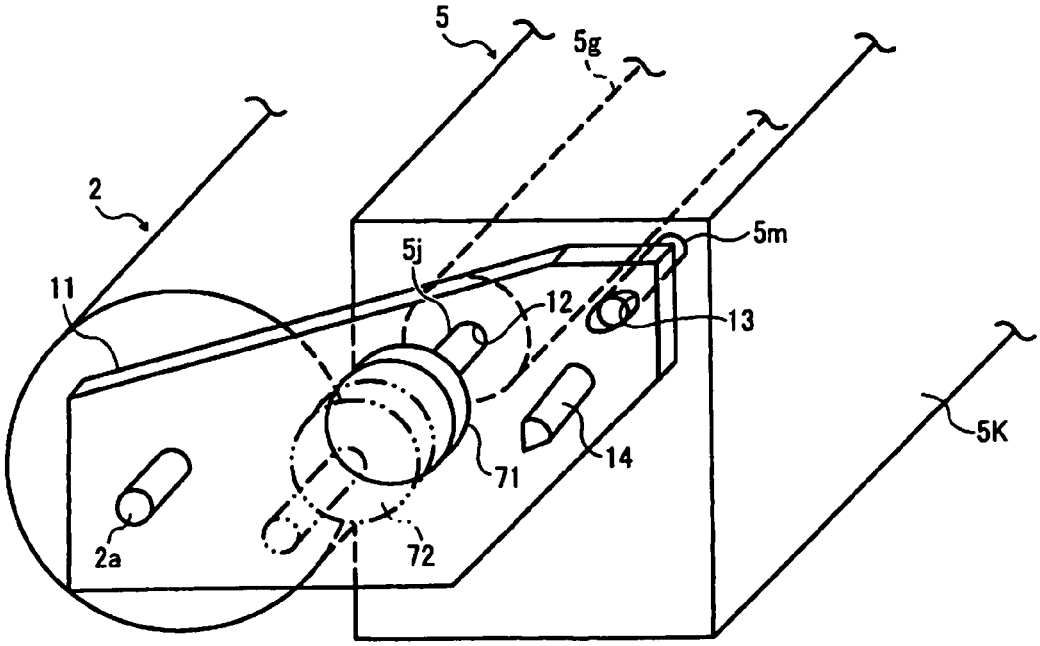
FIG. 3B is a perspective view of the process cartridge when viewed from the rear side of the apparatus main-body.
Figure 4:
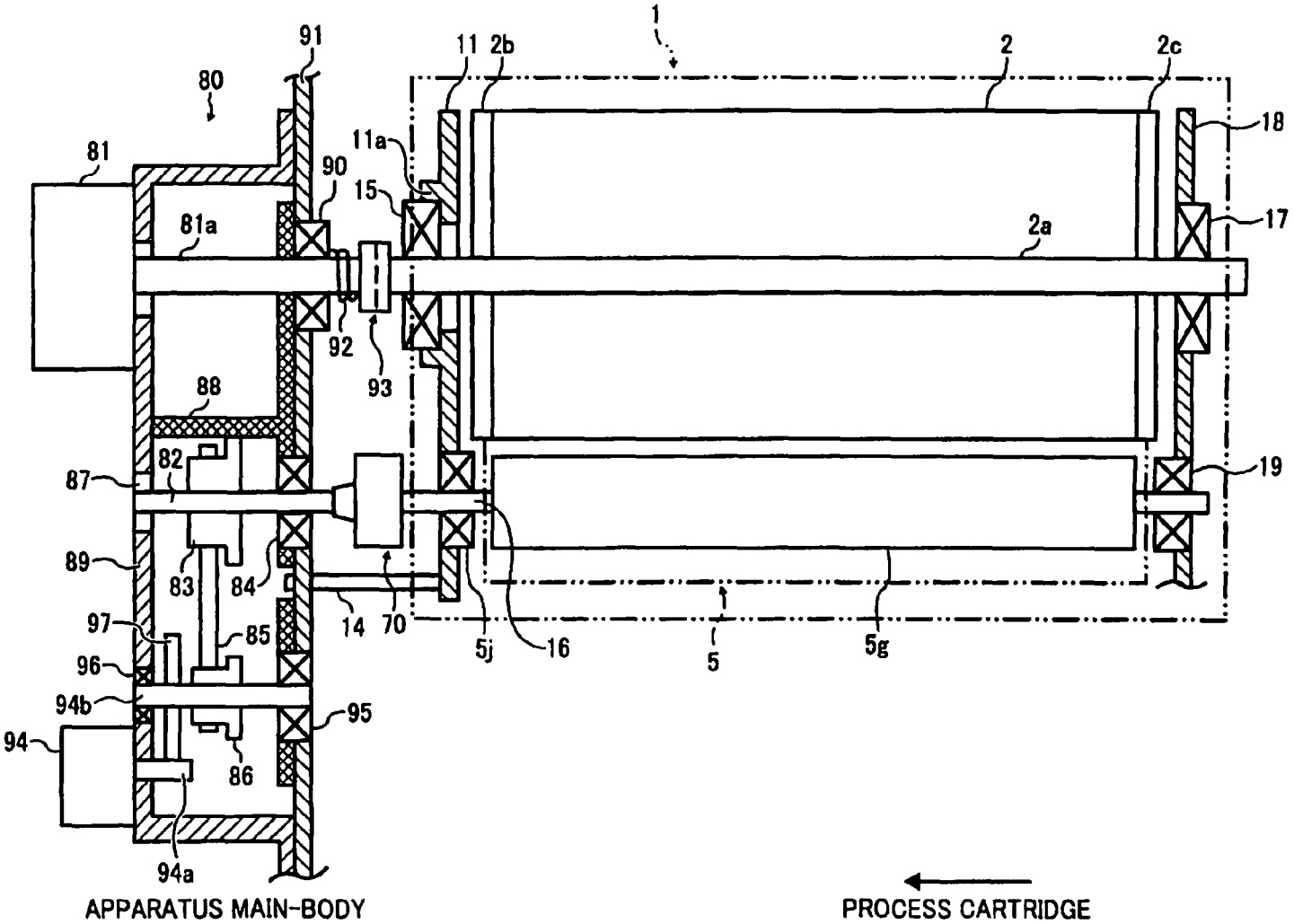
FIG. 4 is a schematic diagram in which the process cartridge is shown installed in the apparatus main-body.
Figure 5:
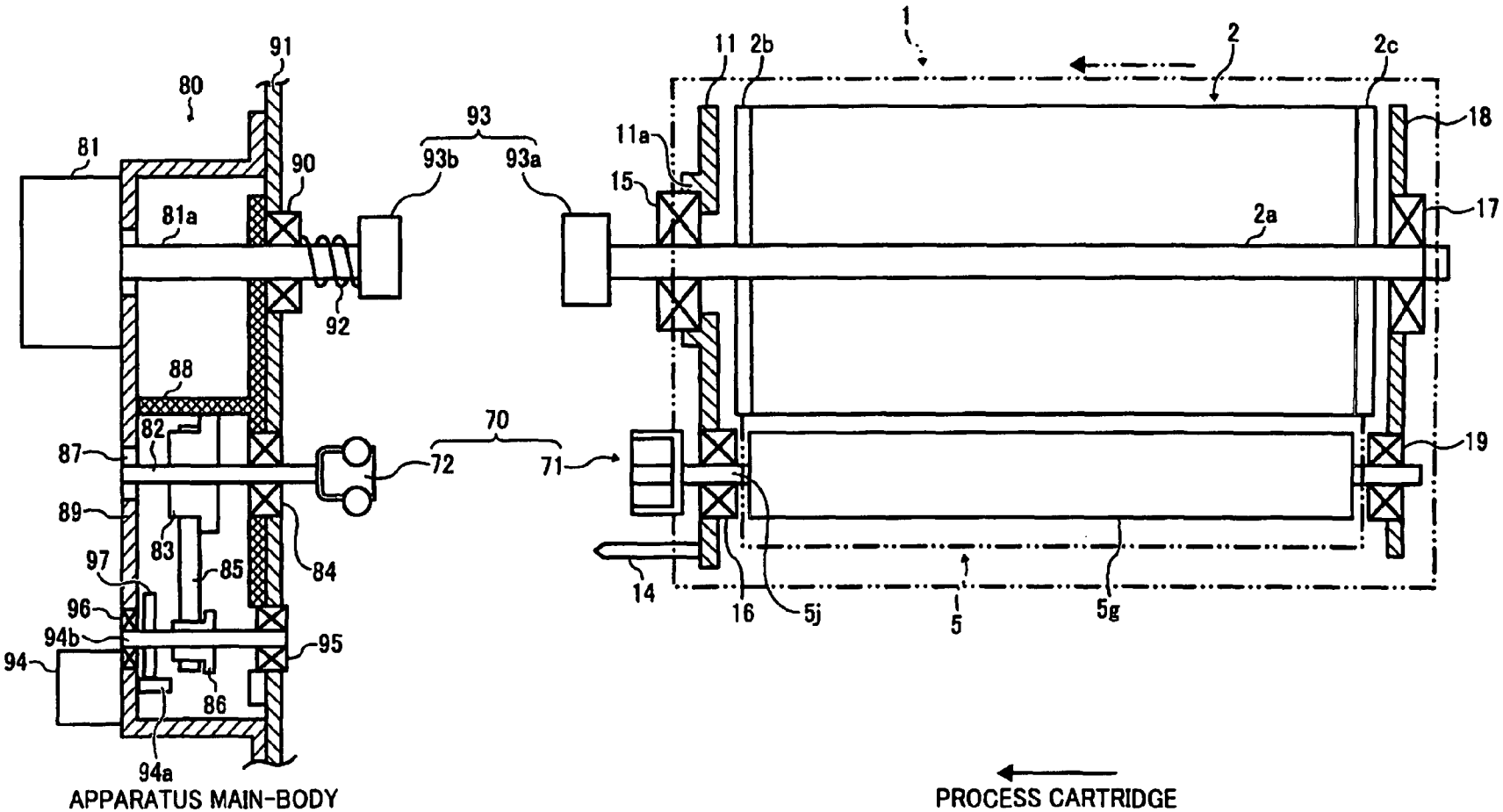
FIG. 5 is a schematic diagram in which the process cartridge is shown detached from the apparatus main-body.

FIG. 3A is a front view of the process cartridge 1 when viewed from the rear side of the apparatus main-body. FIG. 3B is a perspective view of the process cartridge 1 when viewed from the rear side of the apparatus main-body. FIG. 4 is a schematic diagram in which the process cartridge 1 is shown installed in the apparatus main-body. FIG. 5 is a schematic diagram in which the process cartridge 1 is shown detached from the apparatus main-body.

As shown in FIG. 4, a cartridge front plate 18 is arranged on the lateral front side of the process cartridge 1, while a cartridge rear plate 11 is arranged on the lateral rear side of the process cartridge 1. The cartridge front plate 18 and the cartridge rear plate 11 rotatably support a drum shaft 2*a*, which is a support shaft of the photosensitive drum 2, and a developing roller shaft 5*j*, which is a support shaft of the developing roller 5*g*. Such a configuration maintains a constant distance between the central axes of the photosensitive drum 2 and the developing roller 5*g*. The drum shaft 2*a* is rotatably supported on the cartridge front plate 18 and the cartridge rear plate 11 via support bearings 17 and 15, respectively. Similarly, the developing roller shaft 5*j* is rotatably supported on the cartridge front plate 18 and the cartridge rear plate 11 via support bearings 19 and 16, respectively. Thus, the photosensitive drum 2 and the developing roller 5*g* are integrally arranged in the process cartridge 1.

The cartridge rear plate 11 has an elongate hole 13 in which a pin 5*m* of the developing unit 5 fits (see FIGS. 3A and 3B). Similarly, the cartridge front plate 18 also has an elongate hole (not shown) in which another pin (not shown) of the developing unit 5 fits. As a result, the developing unit 5 is prevented from rotating around the central axis of the developing roller 5*g*.

As described above, the photosensitive drum 2 and the developing roller 5*g* are integrally arranged at corresponding determined positions to form the process cartridge 1. The cartridge front plate 18 and the cartridge rear plate 11 regulate the distance between the central axes of the photosensitive drum 2 and the developing roller 5*g*. Thus, if arranged slightly apart from each other, the distance between the photosensitive drum 2 and the developing roller 5*g* is maintained constant as shown in FIGS. 3*a* and 3B. On the other hand, if arranged to abut against each other, the abutting pressure between the photosensitive drum 2 and the developing roller 5*g* is regulated. As a result, it is possible to develop a high-quality toner image on the surface of the photosensitive drum 2 irrespective of the arrangement in the process cartridge 1.

A cartridge pin 14 is fixed to the cartridge rear plate 11. A female connector 71 is arranged on the rear end of the developing roller shaft 5*j*. A first engaging member 93*a* is arranged on the rear end of the drum shaft 2*a* (see FIG. 5).

The apparatus main-body includes a driving unit 80 for driving the process cartridge 1. A supporting plate 89 of the driving unit 80 is fixed to a main-body plate 91 by using a screw clamp. When the process cartridge 1 is installed in the apparatus main-body, the main-body plate 91 faces the cartridge rear plate 11. A drum driving motor 81 and a developing-unit driving motor 94 are fixed to the supporting plate 89. The drum driving motor 81 has a drum motor shaft 81*a* that passes through the main-body plate 91. One end of the drum motor shaft 81*a* is rotatably fixed to the main-body plate 91 via a support bearing 90. A second engaging member 93*b* is arranged on the other end of the drum motor shaft 81*a* facing the process cartridge 1. The second engaging member 93*b* is arranged to be movable in the axial direction of the drum motor shaft 81*a* and is biased towards the process cartridge 1 by a coil spring 92, which is twined around the drum motor shaft 81*a*. The second engaging member 93*b* is retained on the drum motor shaft 81*a* by using a retaining pin (not shown).

As described above, the photosensitive drum 2 is rotated by the drum driving motor 81, while the developing roller 5*g* is rotated by the developing-unit driving motor 94. That is, the drum driving motor 81 operates independent of the developing-unit driving motor 94 and is not affected by load fluctuation in the developing-unit driving motor 94. Thus, the drum driving motor 81 can rotate the photosensitive drum 2 with a high degree of accuracy. However, it is also possible to use a single driving motor for rotating the photosensitive drum 2 and the developing roller 5*g*.

A cartridge driving shaft 82 and a driven shaft 94*b* are arranged in the driving unit 80, and are supported on the main-body plate 91 and the supporting plate 89. More particularly, the driven shaft 94*b* is rotatably supported on the supporting plate 89 via a support bearing 96, and supported on the main-body plate 91 and an auxiliary supporting member 88 via a support bearing 95. The cartridge driving shaft 82 is supported on the supporting plate 89 via a shaft holding mechanism 87, and supported on the main-body plate 91 and the auxiliary supporting member 88 via a support bearing 84. The auxiliary supporting member 88 is fixed to the supporting plate 89 by using a screw clamp.

A first pulley 86 and a driven gear 97 are arranged on the driven shaft 94*b*. The driven gear 97 engages with a driving gear (not shown) arranged on a developing-unit driving shaft 94*a* of the developing-unit driving motor 94.

A second pulley 83 is arranged on the cartridge driving shaft 82. A timing belt 85 is stretched around the first pulley 86 and the second pulley 83. A male connector 72 is arranged on an end of the cartridge driving shaft 82 facing the process cartridge 1. A constant-speed joint 70 is formed when the male connector 72 enters into the female connector 71.

Figure 6A:
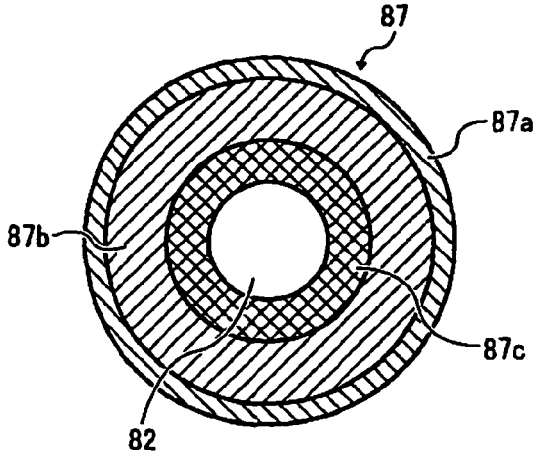
FIGS. 6A to 6C are exemplary diagrams of a shaft holding mechanism in the apparatus main-body.
Figure 6B:
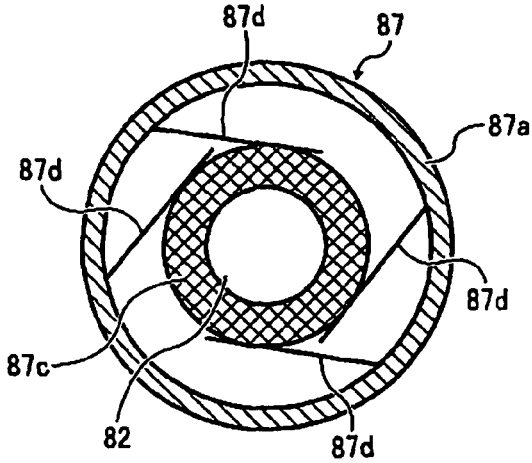
Figure 6C:
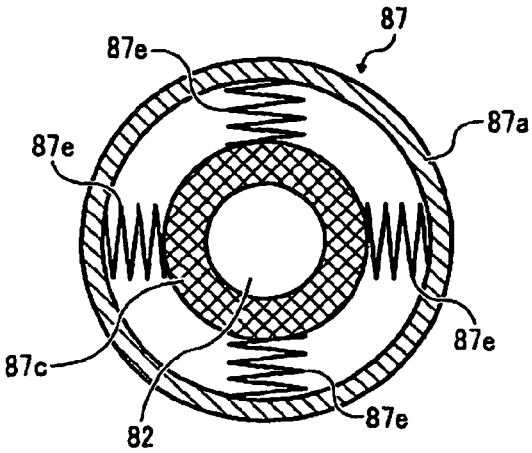
Figure 7:
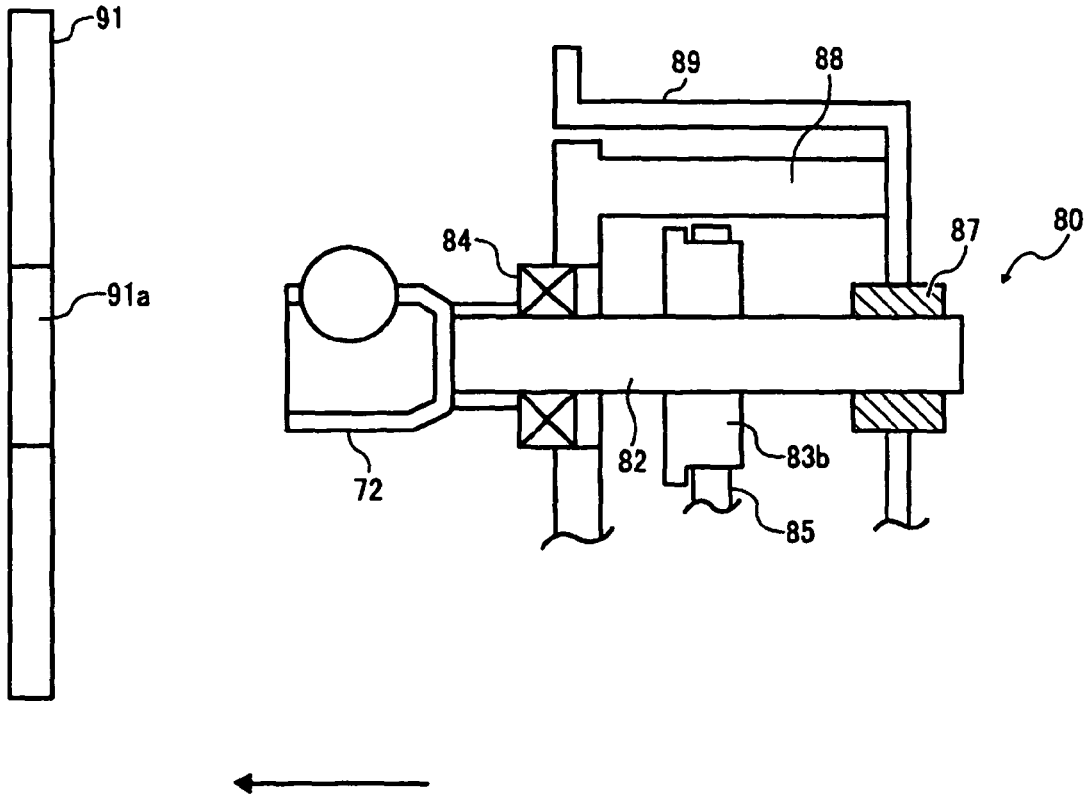
FIG. 7 is an explanatory diagram of a driving unit arranged in the apparatus main-body.

FIGS. 6A to 6C are exemplary schematic diagrams of the shaft holding mechanism 87.

A shaft holding case 87*a* in the shaft holding mechanism 87 includes a support bearing 87*c* surrounded by an elastic material. More particularly, in FIG. 6A, a pliable material 87*b* is arranged around the support bearing 87*c*. In FIG. 6B, a plurality of leaf springs 87*d* are arranged around the support bearing 87*c*. In FIG. 6C, a plurality of coil springs 87*e* are arranged around the support bearing 87*c*. The shaft holding mechanism 87 has a central hole covered by the support bearing 87*c*. One end of the cartridge driving shaft 82 fits in the central hole via the support bearing 87*c*. In this way, the shaft holding mechanism 87 elastically holds the cartridge driving shaft 82 in a movable manner in a radial direction.

When supported on the supporting plate 89 and the main-body plate 91, the cartridge driving shaft 82 passes through a shaft hole 91*a* on the main-body plate 91. In that case, the support bearing 84, which partially engages with the auxiliary supporting member 88, fits in the shaft hole 91*a*.

In this way, one end of the cartridge driving shaft 82 is fixed to the shaft holding mechanism 87 via the support bearing 84, while the other end having the male connector 72 thereon is maintained movable in the radial direction.

Given below is the description of the constant-speed joint 70 that couples the cartridge driving shaft 82 with the developing roller shaft 5*j*.

Figure 8A:
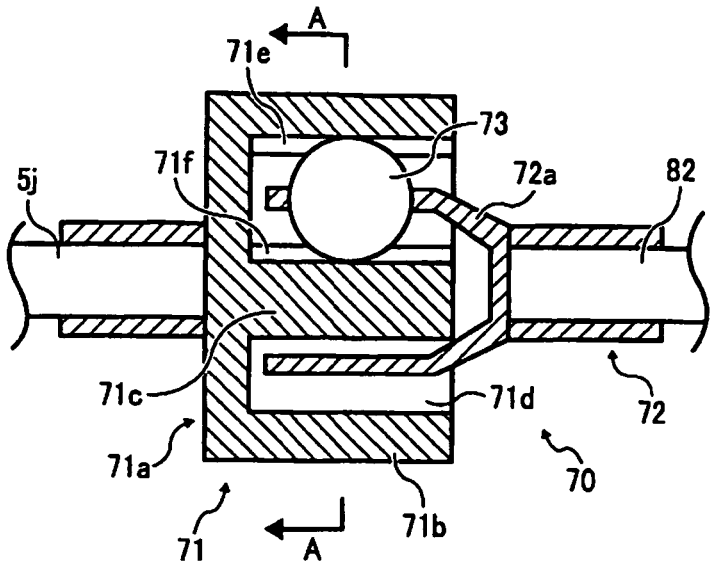
FIG. 8A is an axial sectional view of a constant-speed joint.
Figure 8B:
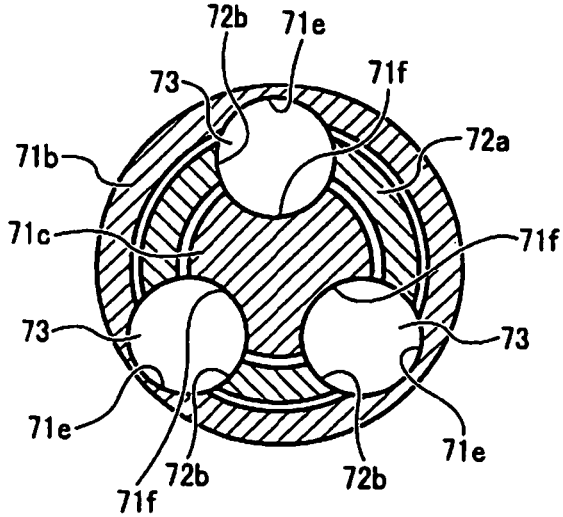
FIG. 8B is a cross-sectional view of the constant-speed joint along a line A-A shown in FIG. 8A.

FIG. 8A is an axial sectional view of the constant-speed joint 70, while FIG. 8B is a cross-sectional view of the constant-speed joint 70 along a line A-A shown in FIG. 8A.

As described above, the constant-speed joint 70 is formed when the male connector 72 enters into the female connector 71. With reference to FIG. 8, the developing roller shaft 5*j* is connected to the female connector 71 from the left side, while the cartridge driving shaft 82 is connected to the male connector 72 from the right side.

One end of the female connector 71 is an axially-oriented and open-ended cylindrical cup-like portion 71*a*, through which the male connector 72 enters into the female connector 71. An open-ended ring-like space 71*d* is formed between an outer ring 71K and an inner ring 71*c* of the cup-like portion 71*a*. Three outer track grooves 71*e* are equidistantly arranged on the inner circumference of the outer ring 71K, while three inner track grooves 71*f* are equidistantly arranged on the outer circumference of the inner ring 71*c*. The male connector 72 enters into the ring-like space 71*d*, which is closed on the other side.

The outer track grooves 71*e* extend along the axial direction of the outer ring 71K and are arranged in a circular manner with a phase difference of 120 degrees therebetween. Similarly, the inner track grooves 71*f* extend along the axial direction of the inner ring 71*c* and are arranged in a circular manner with a phase difference of 120 degrees therebetween. The outer track grooves 71*f* and the inner track grooves 71*e* are arranged facing each other across the ring-like space 71*d*.

The front portion of the male connector 72 is a cylindrical spherical-body holding portion 72*a*. The spherical-body holding portion 72*a* has three through holes 72*b* arranged along the peripheral wall with a phase difference of 120 degrees therebetween. Each through hole 72*b* rotatably holds a spherical body 73 (or balls).

As shown in FIG. 8A, when the spherical-body holding portion 72*a* enters into the ring-like space 71*d*, the spherical bodies 73 are sandwiched between the outer track grooves 71*e* and the inner track grooves 71*f*. As a result, the spherical bodies 73 are prevented from moving in the normal direction. On the other hand, because the outer track grooves 71*e* and the inner track grooves 71*f* extend along the axial direction of the outer ring 71K and the inner ring 71*c*, respectively, the spherical bodies 73 can slide in the axial direction.

When the male connector 72 enters into the female connector 71, the spherical bodies 73 engage with the corresponding outer track grooves 71*e* and the inner track grooves 71*f*. Meanwhile, when the drum motor shaft 81*a* is rotated by the drum driving motor 81, the first pulley 86 also rotates and transmits the torque to the second pulley 83 via the timing belt 85. As a result, the cartridge driving shaft 82 starts rotating. When the spherical bodies 73 are in engagement with the corresponding outer track grooves 71*e* and the inner track grooves 71*f*, the torque of the cartridge driving shaft 82 is transmitted to the female connector 71, i.e., to the developing roller shaft 5*j*. Thus, the developing roller shaft 5*j* and the developing roller 5*g* rotate at a constant speed at which the cartridge driving shaft 82 is rotating.

As described above, the track grooves (outer track grooves 71*e* or inner track grooves 71*f*) are arranged on the outer ring 71K as well as the inner ring 71*c*. However, it is also possible to arrange the track grooves on either one of the outer ring 71K and the inner ring 71*c*.

Meanwhile, it is desirable that the female connector 71 and the male connector 72 are made of an injection-moldable synthetic resin. In that case, the synthetic resin can be either one of a thermoplastic resin and a thermosetting resin. There are two types of the injection-moldable synthetic resin, viz., a crystalline resin and an amorphous resin. Although either one of the crystalline resin and the amorphous resin can be used, it is desirable to use the crystalline resin. That is because the amorphous resin has a low degree of fracture toughness and is thus susceptible to sudden damage when subjected to a torque more than a tolerable limit. Moreover, it is also desirable to use a synthetic resin having high lubricative properties. Considering such criteria, the female connector 71 and the male connector 72 can be made of synthetic resins such as polyacetal resin or polyoxymethylene (POM) resin, nylon resin, injection-moldable fluorine resin (e.g., polytetrafluoroethylene-perfluoroalkyl vinyl ether copolymer (PFA) resin, Perfluorinated Ethylene-Propylene Copolymer (FEP) resin, Ethylene tetrafluoroethylene (ETFE) resin, and the like), injection-moldable polyimide resin, Polyphenylene Sulfide (PPS) resin, wholly aromatic polyester, polyether ether ketone (PEEK) resin, and polyamide-imide resin. Moreover, the abovementioned synthetic resins may be used independently or by preparing a polymer alloy of two or more synthetic resins. Furthermore, a synthetic resin having comparatively lower lubricative properties can also be used by preparing a polymer alloy with the abovementioned synthetic resins.

The most suitable synthetic resin is a slidable resin such as the POM resin, the nylon resin, the PPS resin, and the PEEK resin. In the case of nylon resin, it is possible to use nylon6 resin, nylon66 resin, nylon610 resin, nylon612 resin, nylon11 resin, nylon12 resin, nylon46 resin, or semiaromatic nylon resin having an aromatic ring in the molecular chain. Meanwhile, because the POM resin, the nylon resin, and the PPS resin offer a high degree of heat resistivity and slidability at a comparatively moderate price, it can be used to manufacture a cost-effective constant-speed joint 70. On the other hand, because the PEEK resin has a high degree of mechanical strength and slidability without mixing a reinforcing agent or a lubricating agent, it can be used to manufacture a high-performance constant-speed joint 70.

By using a resin material to manufacture the female connector 71 and the male connector 72, the constant-speed joint 70 becomes lighter in weight than a conventional metallic configuration. Moreover, the slidability of the resin material facilitates smooth sliding of the spherical bodies 73 over the outer track grooves 71*e* and the inner track grooves 71*f* without greasing the ring-like space 71*d*. That reduces the operating noise of the constant-speed joint 70 as compared to a conventional metallic configuration. Meanwhile, a slidable resin material can be used to manufacture only the spherical bodies 73, or only the cup-like portion 71*a* and the spherical-body holding portion 72*a*, or the entire female connector 71 and the entire male connector 72.

Given below is the description of installing the process cartridge 1 in the apparatus main-body.

The position of the process cartridge 1 with respect to the apparatus main-body in the radial direction is determined based primarily on the drum shaft 2*a* and secondarily on the cartridge pin 14. More particularly, the position of the process cartridge 1 is determined when the first engaging member 93*a* engages with the second engaging member 93*b* (see FIGS. 4 and 5). Moreover, the cartridge pin 14 fits in a position determining hole 98 (see FIGS. 9A and 9B). In this way, the position of the process cartridge 1 is correctly determined with respect to the apparatus main-body and prevented from rotating around the central axis of the photosensitive drum 2.

Figure 9A:
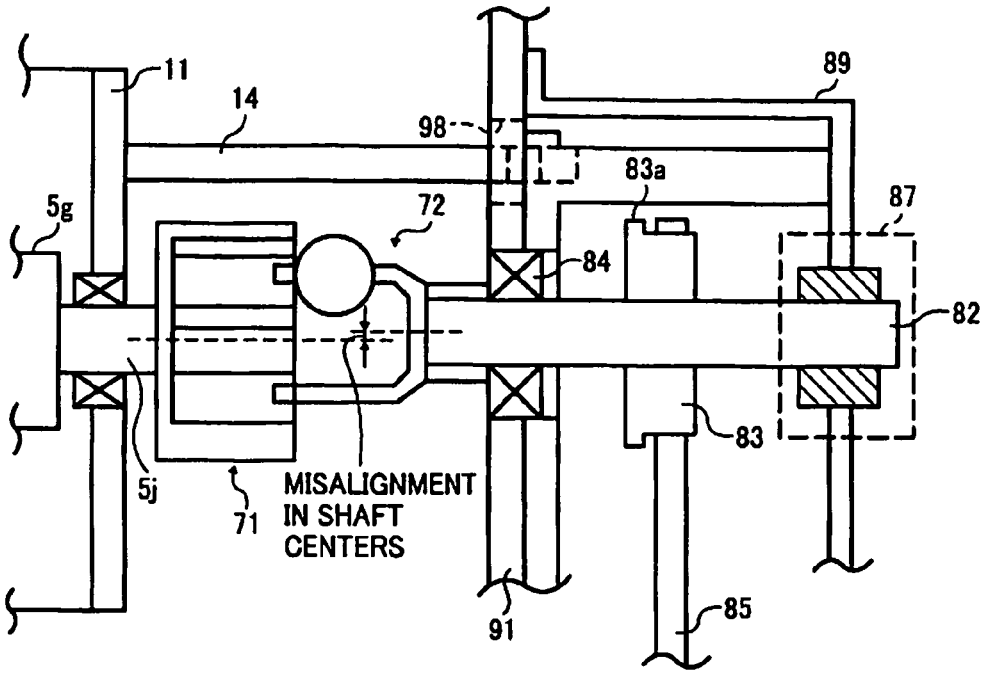
FIG. 9A is an explanatory diagram in which a male connector is yet to enter into a female connector.

However, even if the position of the process cartridge 1 is correctly determined with respect to the apparatus main-body, accumulation of the positioning tolerance may sometime lead to a misalignment in the shaft centers of the developing roller shaft 5*j* and the cartridge driving shaft 82 in the radial direction (see FIG. 9A). In that case, the spherical bodies 73 abut against the outer ring 71K or the inner ring 71*c* from outside, and are blocked from entering into the ring-like space 71*d*. If the process cartridge 1 is further pressed towards the apparatus main-body, then the elastic material surrounding the support bearing 87*c* (i.e., the pliable material 87B, the leaf springs 87*d*, or the coil springs 87*e*) elastically deforms such that the cartridge driving shaft 82 slightly tilts with respect to the support bearing 84. That enables the spherical-body holding portion 72*a* to enter into the ring-like space 71*d*. However, because the elastic member immediately tries to return to its original shape, the cartridge driving shaft 82 is prevented from tilting by a large angle. Thus, the spherical-body holding portion 72*a* enters into the ring-like space 71*d* after the position of the process cartridge 1 with respect to the apparatus main-body is determined. Thus, when the male connector 72 enters into the female connector 71, the position of the cartridge driving shaft 82 in the radial direction is determined.

Figure 9B:
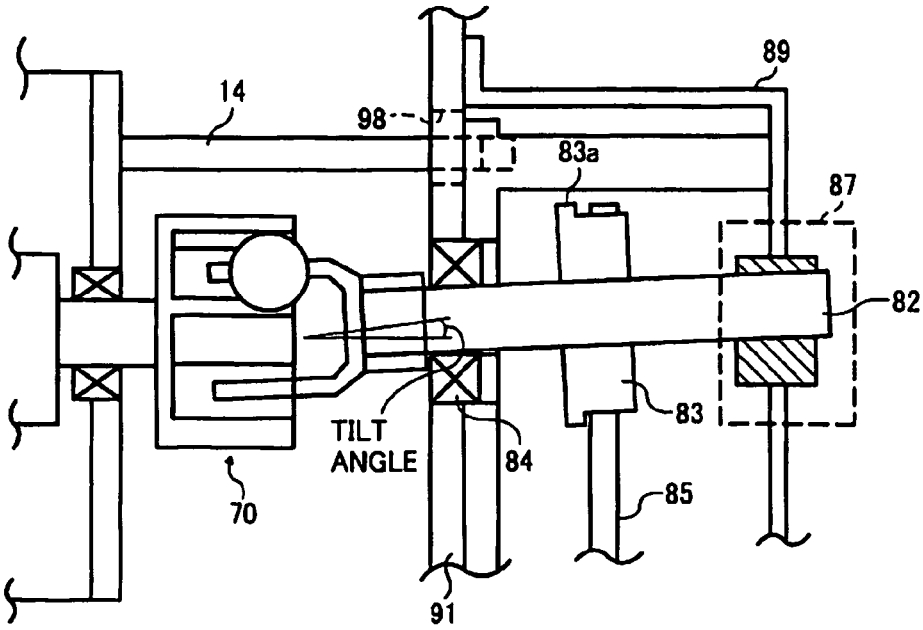
FIG. 9B is an explanatory diagram in which the male connector has entered into the female connector.
Figure 18:
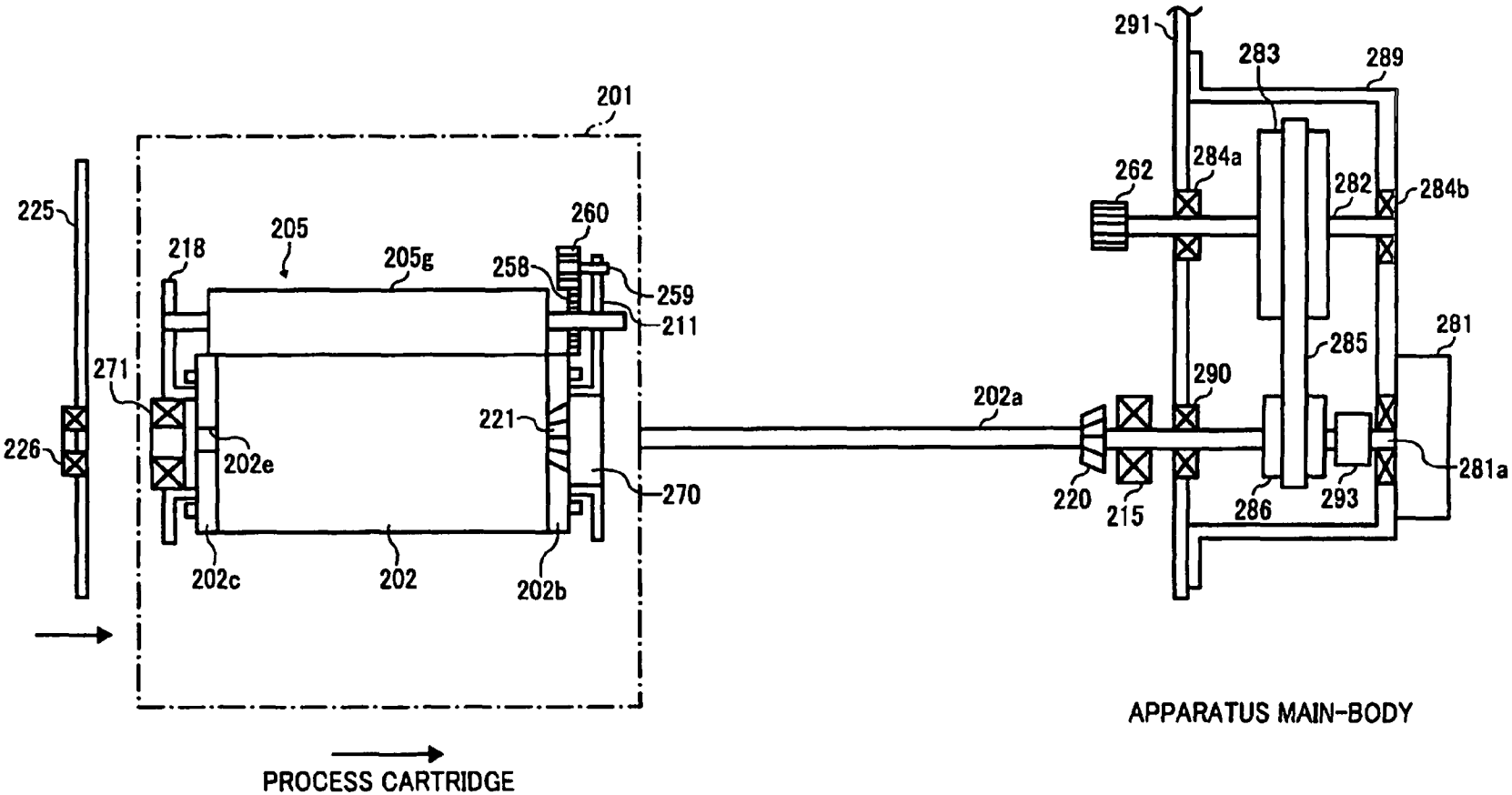
FIG. 18 is a schematic diagram in which a process cartridge is shown detached from a conventional apparatus main-body.
Figure 19:
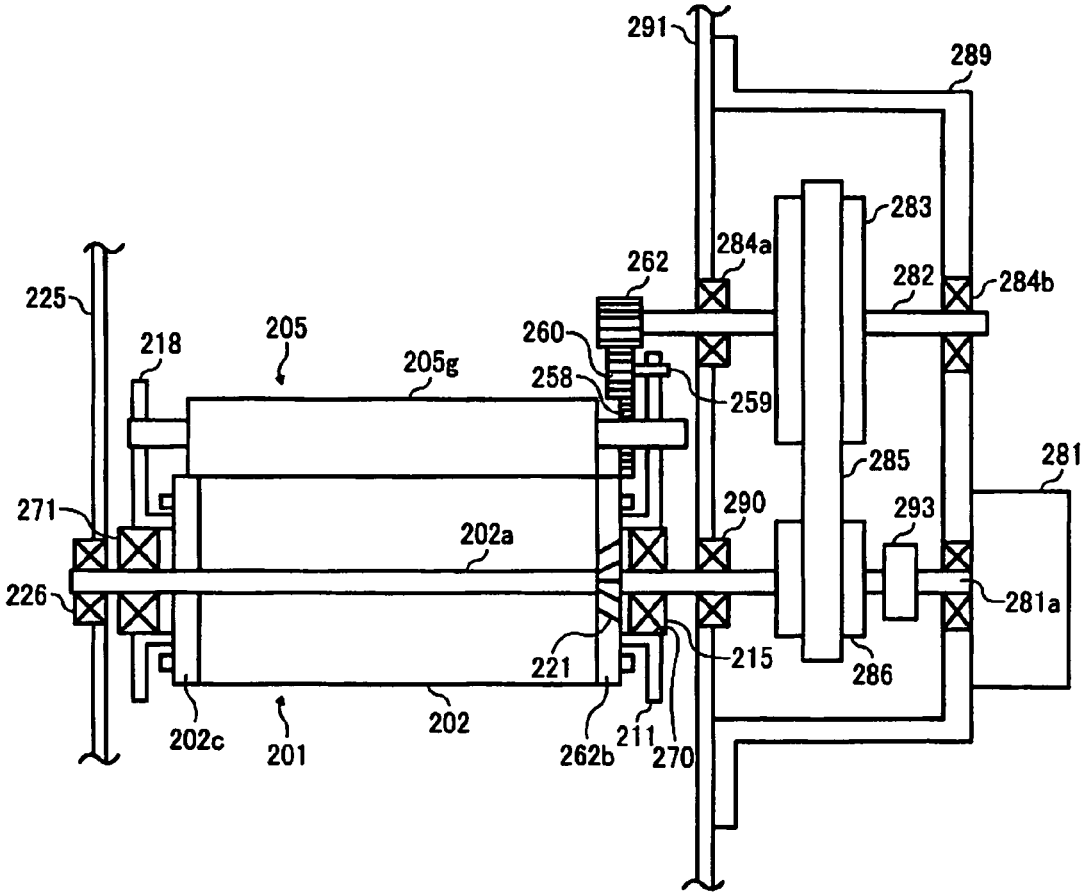
FIG. 19 is a schematic diagram in which the process cartridge is shown installed in the apparatus main-body.
Figure 20A:
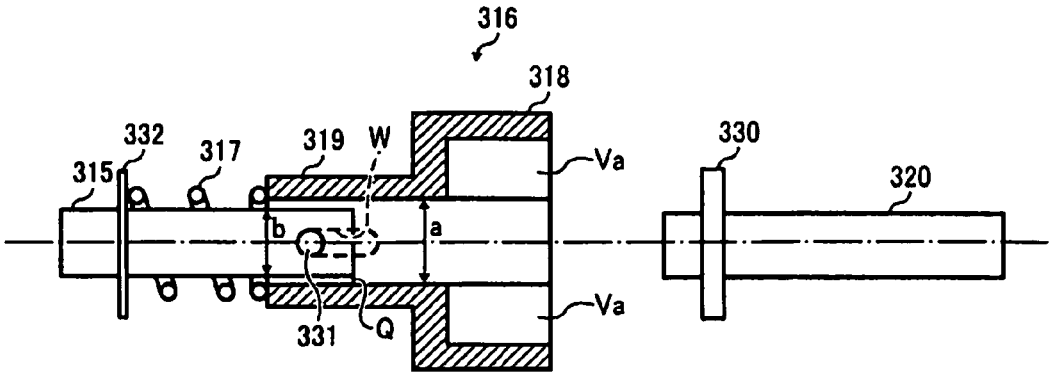
FIGS. 20A to 20C are explanatory diagrams of a conventional coupling mechanism.
Figure 20B:
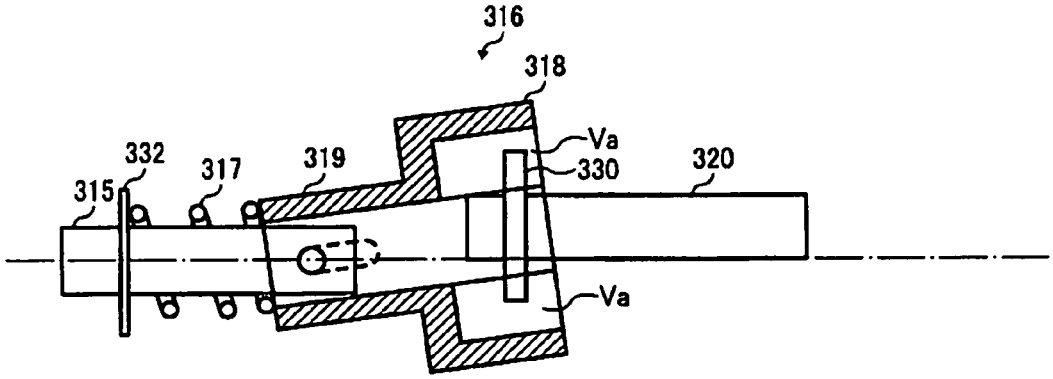
Figure 20C:
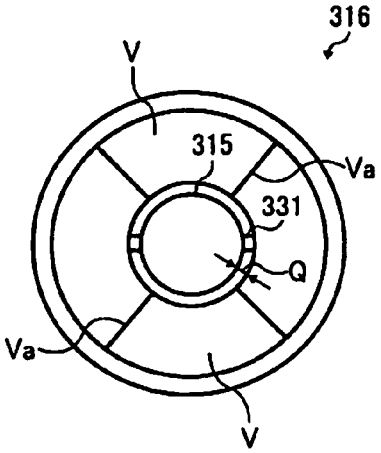
Figure 21A:
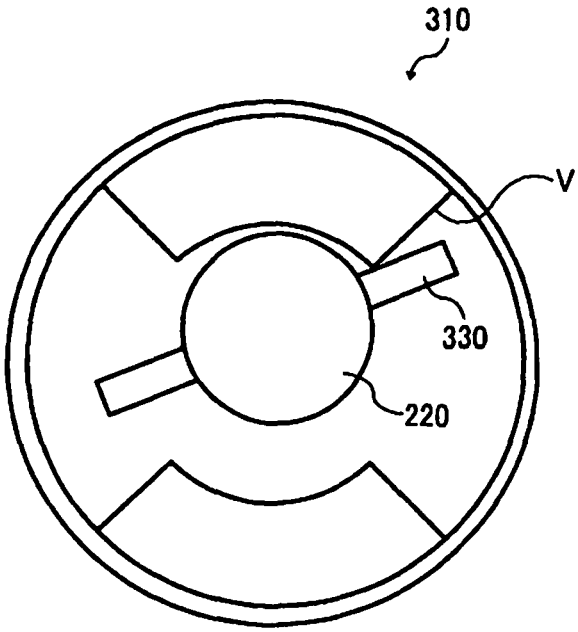
FIGS. 21A and 21B are explanatory diagrams of a driving pin in the conventional coupling mechanism.
Figure 21B:
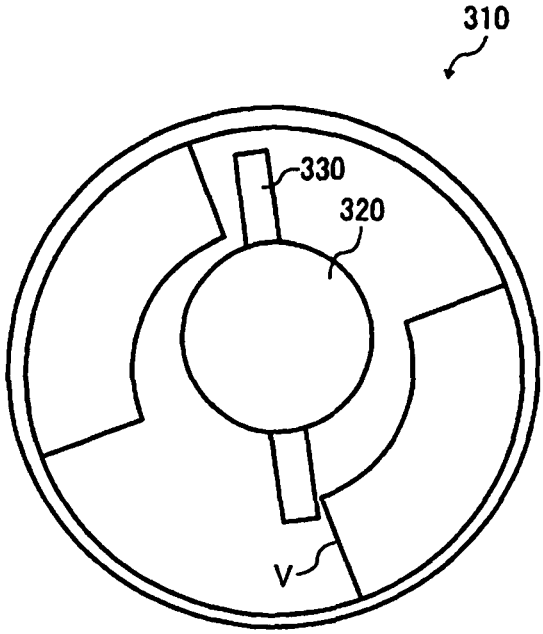

That is, the cartridge driving shaft 82 is fixed in the radial direction only at the support bearing 84 (one-point support, see FIG. 9B). Consequently, the end of the cartridge driving shaft 82 facing the process cartridge 1 is maintained to be moveable. Thus, even if a misalignment occurs in the shaft centers of the developing roller shaft 5*j* and the cartridge driving shaft 82, the cartridge driving shaft 82 can tilt by a tilt angle θ for getting coupled with the developing roller shaft 5*j*. Such one-point support configuration saves the cartridge driving shaft 82 from being subjected to a deformation in the radial direction, which can happen in a two-point support configuration (see FIGS. 18 and 19).

As described above, the spherical bodies 73 slide along the outer track grooves 71*e* and the inner track grooves 71*f* in the constant-speed joint 70 between the cartridge driving shaft 82 and the developing roller shaft 5*j*. When the cartridge driving shaft 82 rotates with the tilt angle θ, the spherical bodies 73 perform back-and-forth sliding movement along the outer track grooves 71*e* and the inner track grooves 71*f* to negate any effect of speed fluctuation due to the tilt. As a result, irrespective of the tilt angle θ, the developing roller shaft 5*j* and the developing roller 5*g* rotate at a constant speed thereby preventing variation in image density.

Figure 10:
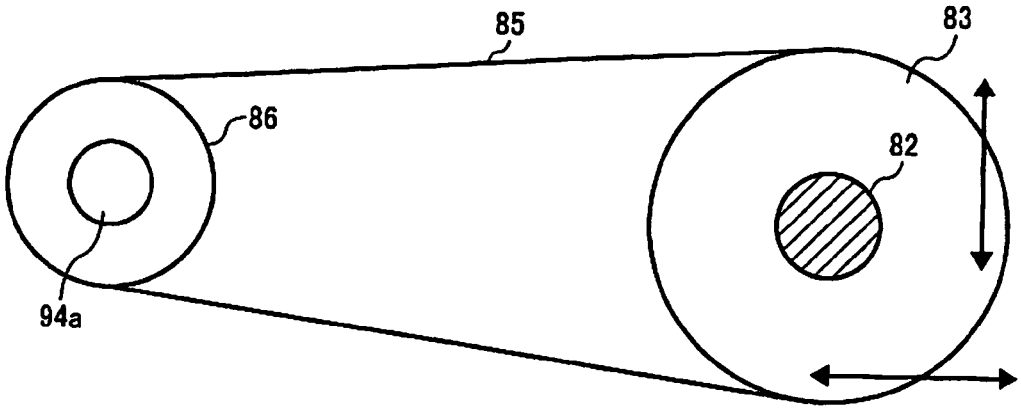
FIG. 10 is an explanatory diagram of a second pulley tilting along with a tilt in a cartridge driving shaft.

When the cartridge driving shaft 82 rotates with the tilt angle θ, the second pulley 83 tilts as shown in FIG. 10. However, the timing belt 85 negates the tilt of the second pulley 83 such that the driving force is efficiently transmitted to the cartridge driving shaft 82. As a result, the constituent elements upstream of the cartridge driving shaft 82 in the direction of torque transmission are prevented from being damaged.

Figure 11:
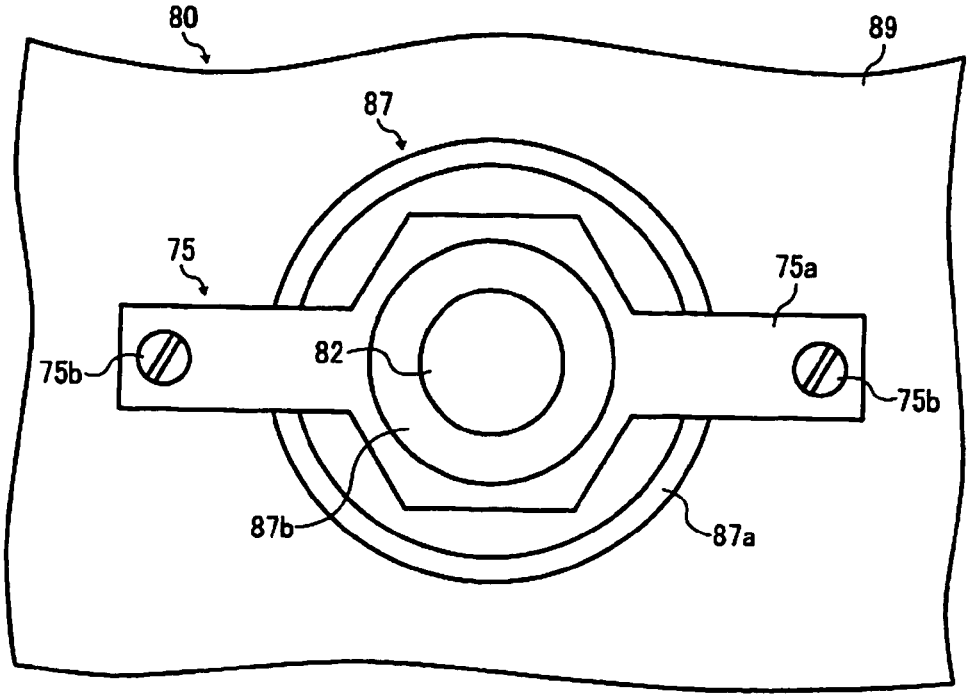
FIG. 11 is an explanatory diagram of a clamping unit arranged on the shaft holding mechanism.

After the process cartridge 1 is installed in the apparatus main-body and the position of the cartridge driving shaft 82 is determined, a clamping unit 75 in the shaft holding mechanism 87 is used to clamp the cartridge driving shaft 82 to the supporting plate 89 in a rotatable manner (see FIG. 11). The clamping unit 75 includes a bracket plate 75*a* that holds the pliable material 87*b* and setscrews 75*b* that are used to clamp the ends of the bracket plate 75*a*. Thus, after the process cartridge 1 is installed in the apparatus main-body, the position of the cartridge driving shaft 82 is fixed in the shaft holding mechanism 87. The screw holes on the bracket plate 75*a*, in which the setscrews 75*b* are winded, can be made sufficiently large such that they can also be used for electromagnetic clamping.

By rotatably clamping the cartridge driving shaft 82 to the supporting plate 89, the amount of vibration generated due to the rotation of the cartridge driving shaft 82 can be curbed thereby preventing a traverse stripe effect in an image.

To detach the process cartridge 1, it can be pulled out from the apparatus main-body by opening a front door (not shown) of the apparatus main-body. At that time, the constant-speed joint 70 is released such that the female connector 71 detaches from the male connector 72. Thus, to sum up, the constant-speed joint 70 couples the developing roller shaft 5*j* with the cartridge driving shaft 82 by negating the tilt angle θ of the cartridge driving shaft 82. Thus, it is not necessary to separately arrange a coupling mechanism and a tilt angle negating mechanism thereby reducing the constituent elements and the manufacturing cost of the image forming apparatus.

After detaching the process cartridge 1 from the apparatus main-body, the photosensitive drum 2 and the developing unit 5 can be separated by removing the cartridge front plate 18 and the cartridge rear plate 11.

Meanwhile, the process cartridge 1 includes a guiding member (not shown) that engages with a guiding rail (not shown) in the apparatus main-body such that the process cartridge 1 can slide in the apparatus main-body along the guide rail for installation or detachment.

Figure 12A:
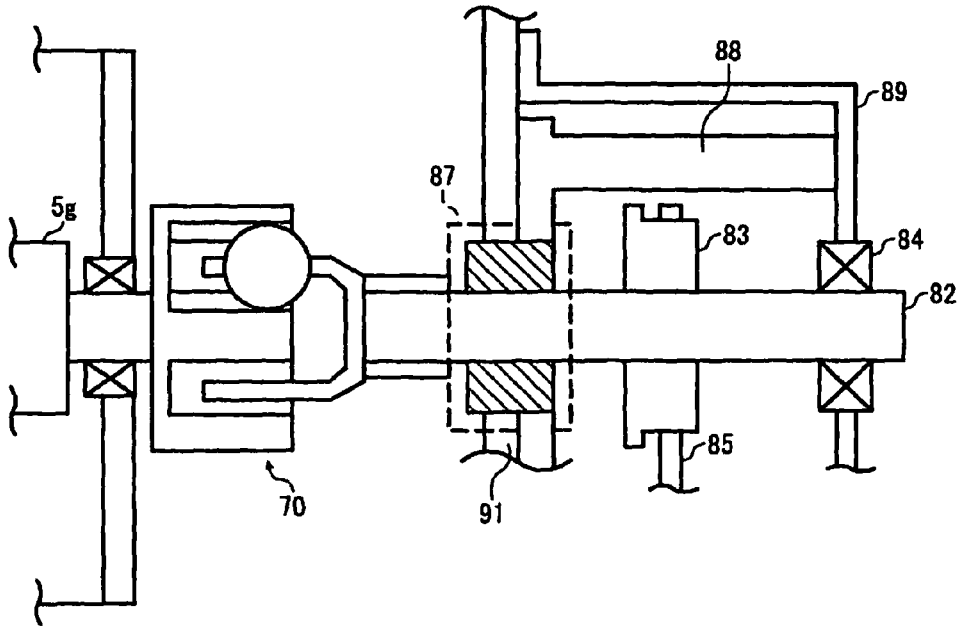
FIGS. 12A and 12B are explanatory diagrams of essential parts according to a first modification of the embodiment.
Figure 12B:
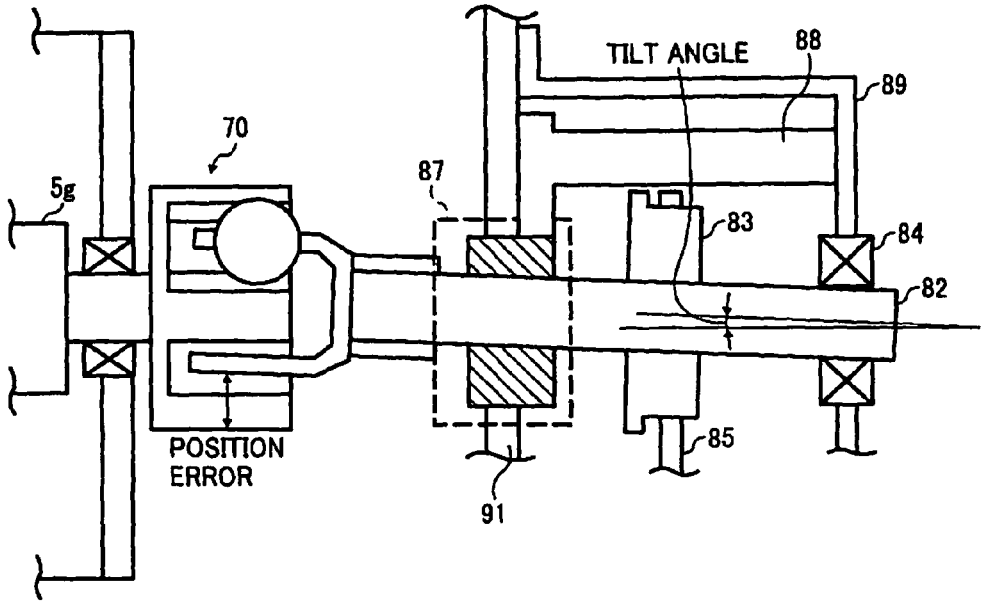

FIGS. 12A and 12B are enlarged views of essential parts according to a first modification of the embodiment. As described above, the cartridge driving shaft 82 is supported on the supporting plate 89 via the shaft holding mechanism 87, and supported on the main-body plate 91 and the auxiliary supporting member 88 via the support bearing 84. However, according to first modification, the cartridge driving shaft 82 is supported on the supporting plate 89 via the support bearing 84, and supported on the main-body plate 91 and the auxiliary supporting member 88 via the shaft holding mechanism 87. In that case also, if the shaft centers of the developing roller shaft 5*j* and the cartridge driving shaft 82 are out of alignment, the shaft holding mechanism 87 elastically deforms such that the cartridge driving shaft 82 slightly tilts with respect to the support bearing 84. As a result, the spherical-body holding portion 72*a* can enter into the ring-like space 71*d*.

Moreover, instead of arranging the support bearing 84 on the main-body plate 91 and the auxiliary supporting member 88 as described above, it is arranged on the supporting plate 89 such that the cartridge driving shaft 82 is supported at a farther position from the end thereof facing the process cartridge 1. Such a configuration reduces the tilt angle θ of the cartridge driving shaft 82. Thus, even if the shaft centers of the developing roller shaft 5*j* and the cartridge driving shaft 82 are out of alignment by a large degree, the tilt angle θ can be controlled within a tolerable range within which the cartridge driving shaft 82 and the developing roller shaft 5*j* can rotate at a constant speed via the constant-speed joint 70.

Figure 13:
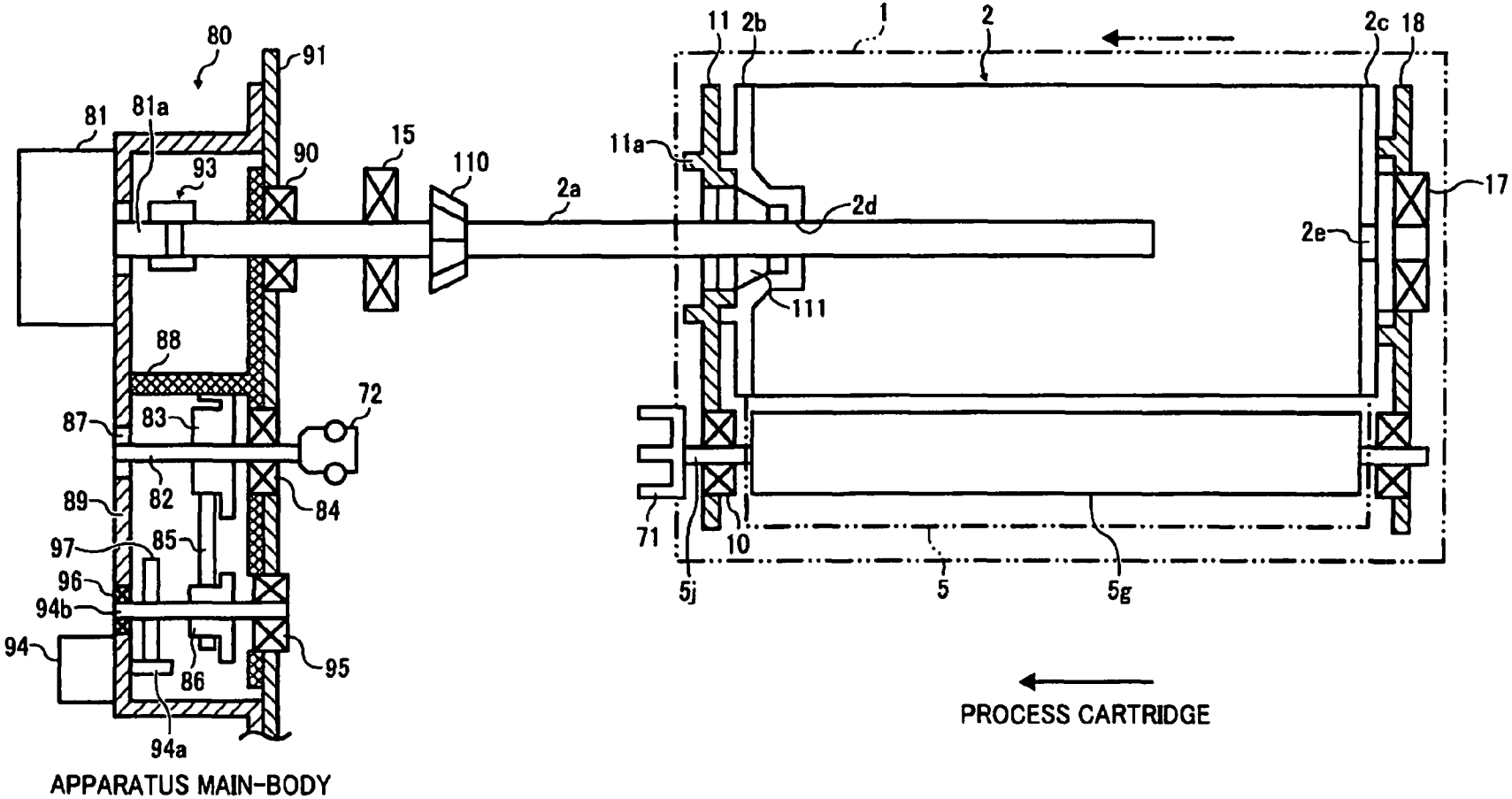
FIG. 13 is a schematic diagram in which the process cartridge is shown installed in the apparatus main-body according to a second modification of the embodiment.

FIG. 13 is a schematic diagram in which the process cartridge 1 is shown installed in the apparatus main-body according to a second modification of the embodiment.

According to the second modification, instead of arranging the drum shaft 2*a* in the process cartridge 1, it is arranged in the apparatus main-body. In that case, the position of the process cartridge 1 with respect to the apparatus main-body is determined when the drum shaft 2*a* passes through a rear drum-shaft hole 2*d* on a rear flange 2*b* of the photosensitive drum 2.

More particularly, as shown in FIG. 13, a concave gear 111 is arranged on the outer surface of the rear flange 2*b* of the photosensitive drum 2. The concave gear 111 has a conical pitch surface and the rear drum-shaft hole 2*d* at the center. A front flange 2*c* of the photosensitive drum 2 has a front drum-shaft hole 2*e*. The photosensitive drum 2 is rotatably supported on the cartridge rear plate 11 and the cartridge front plate 18. The position of the photosensitive drum 2 is not determined when the process cartridge 1 is in a detached state.

The drum shaft 2*a* is rotatably fixed to the main-body plate 91 via the support bearing 90. A coupling mechanism 93 linearly couples the drum shaft 2*a* with the drum motor shaft 81*a*.

When the process cartridge 1 is installed in the apparatus main-body, the concave gear Ill engages with a convex gear 110 on the drum shaft 2*a* such that the position of the photosensitive drum 2 with respect to the apparatus main-body is determined. Such a configuration enables to maintain a constant distance between the central axes of the photosensitive drum 2 and the developing roller 5*g*. At the same time, an engagement slot 11*a* on the cartridge rear plate 11 engages with a support bearing 15 on the drum shaft 2*a* such that the position of the process cartridge 1 with respect to the apparatus main-body is also determined.

In this way, the position of the process cartridge 1 with respect to the apparatus main-body is determined based on the drum shaft 2*a*, which leaves a possibility that the shaft centers of the developing roller shaft 5*j* and the cartridge driving shaft 82 fall out of alignment. However, because the cartridge driving shaft 82 elastically holds the shaft holding mechanism 87 in a movable manner in the radial direction, the cartridge driving shaft 82 can tilt for getting coupled with the developing roller shaft 5*j* via the constant-speed joint 70. Thus, the developing roller shaft 5*j* and the developing roller 5*g* rotate at a constant speed thereby preventing variation in image density.

The above description of the constant-speed joint 70 is given with reference to the coupling of the developing roller shaft 5*j* with the cartridge driving shaft 82. Similarly, a constant-speed joint can be used to couple a charging roller shaft of a charging unit with a charging-unit driving shaft of the apparatus main-body, or a lubricant roller shaft of a lubricant coating unit with a lubricant-roller driving shaft of the apparatus main-body. Given below is the description of using the constant-speed joint 70 to couple the detachable fixing unit 60 with the apparatus main-body.

Figure 14:
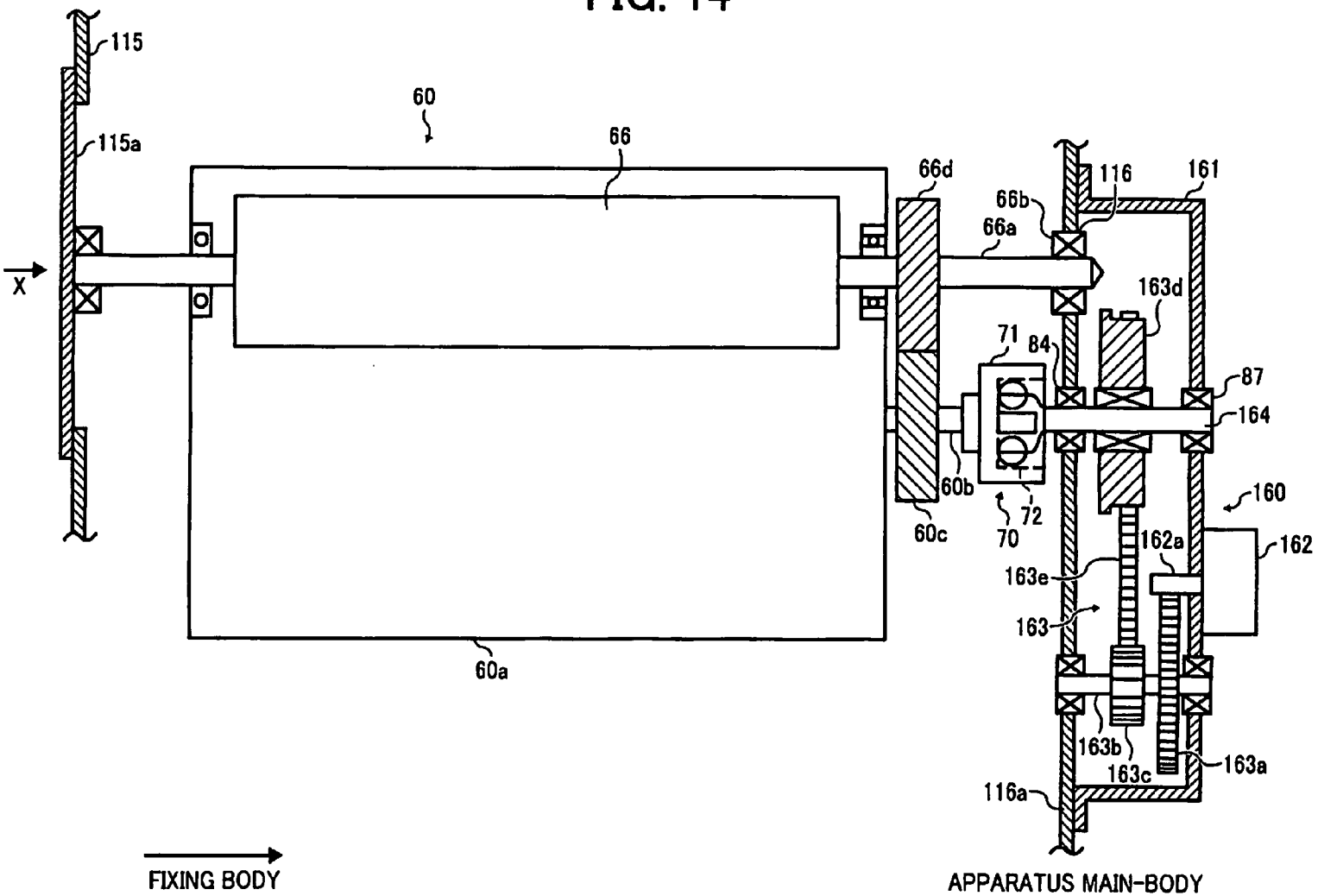
FIG. 14 is a schematic diagram in which a fixing unit is shown installed in the apparatus main-body.

FIG. 14 is a schematic diagram in which the fixing unit 60 is shown installed in the apparatus main-body.

The driving roller 66 is arranged in a case 60*a* of the fixing unit 60 and is supported by a driving roller shaft 66*a*. A driven shaft 60*b* is rotatably supported on the lateral rear side of the case 60*a*. A roller gear 66*d* arranged on the driving roller shaft 66*a* engages with a driven gear 60*c* arranged on the driven shaft 60*b*. The female connector 71 is concentrically arranged on the front end of the driven shaft 60*b*. One end of the driving roller shaft 66*a* is rotatably supported on a front face plate 115*a*, which is arranged on a main-body front plate 115 of the apparatus main-body, while the other end of the driving roller shaft 66*a* is rotatably supported in a rear plate hole 116*a* on a main-body rear plate 116 via a support bearing 66*b*.

The apparatus main-body includes a driving unit 160 for driving the fixing unit 60. The driving unit 160 includes a supporting plate 161, a fixing-unit driving motor 162, a transmission mechanism 163, and a fixing-unit driving shaft 164. The fixing-unit driving motor 162 is fixed to the supporting plate 161. The transmission mechanism 163 includes a transmission gear 163*a*, a transmission pulley 163*c*, a transmitted pulley 163*d*, and a timing belt 163*e*. The transmission gear 163*a* is fixed to a rotating shaft 163*b*, which is rotatably supported on the supporting plate 161 and the main-body rear plate 116. The transmission gear 163*a* engages with an output gear 162*a* arranged on the fixing-unit driving motor 162. The transmission pulley 163*c* is also fixed to the rotating shaft 163*b*. The transmitted pulley 163*d* is fixed to the fixing-unit driving shaft 164, which is rotatably supported on the supporting plate 161 and the main-body rear plate 116. The timing belt 163*e* is stretched around the transmission pulley 163*c* and the transmitted pulley 163*d*. The torque from the fixing-unit driving motor 162 is transmitted to the fixing-unit driving shaft 164 via the output gear 162*a*, the transmission gear 163*a*, the rotating shaft 162*b*, the transmission pulley 163*c*, the timing belt 163*e*, and the transmitted pulley 163*d*, in that order.

When the fixing unit 60 is installed in the apparatus main-body, the support bearing 66*b* fits in the rear plate hole 116*a* such that the position of the fixing unit 60 with respect to the apparatus main-body is determined. However, even if the position of the fixing unit 60 is correctly determined, accumulation of the positioning tolerance may sometime lead to a misalignment in the shaft centers of the driven shaft 60*b* and the fixing-unit driving shaft 164. In that case, the spherical bodies 73 abut against the outer ring 71K or the inner ring 71*c* from outside, and are blocked from entering into the ring-like space 71*d*. However, because the fixing-unit driving shaft 164 slightly tilts with respect to the support bearing 84, the spherical-body holding portion 72*a* can enter into the ring-like space 71*d*. As a result, the driven shaft 60*b* gets coupled with the fixing-unit driving shaft 164 and the driving roller 66 can be rotated at a constant speed. That prevents inconsistency in fixing an image.

Figure 15:
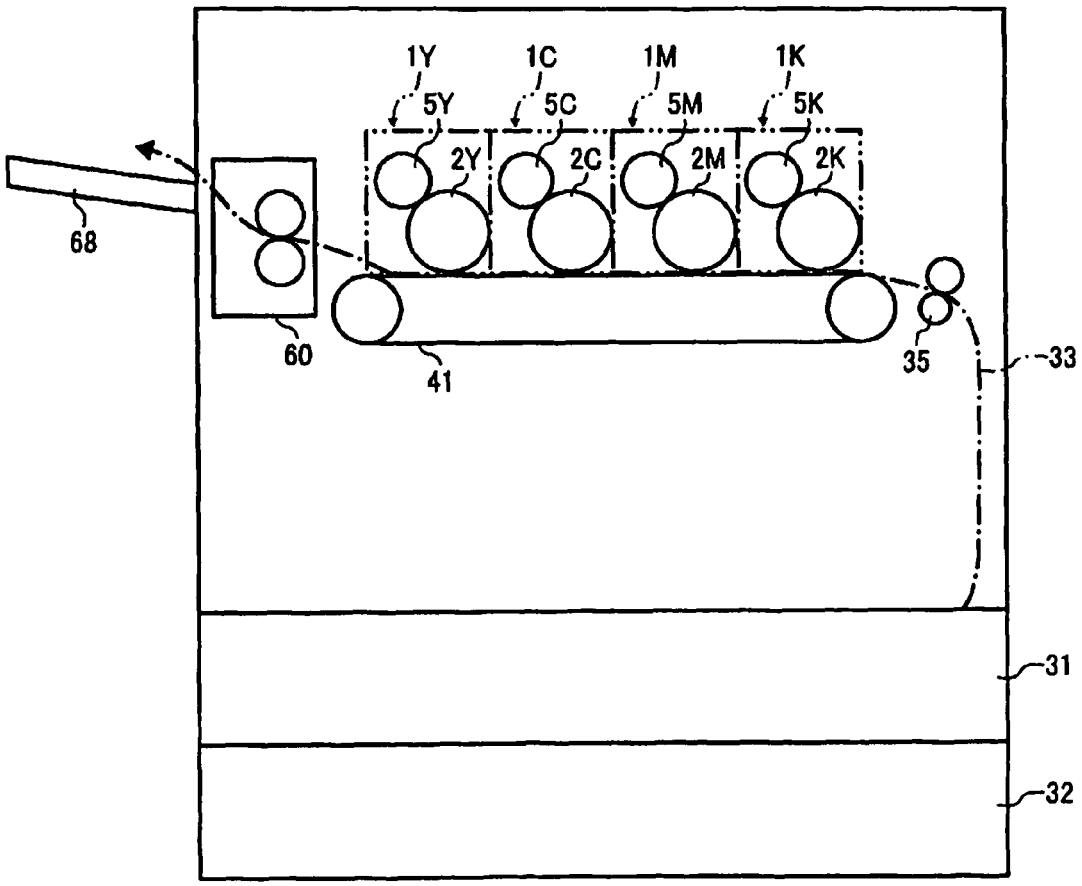
FIG. 15 is a schematic diagram of a tandem-type color image forming apparatus employing a direct transfer system.
Figure 16:
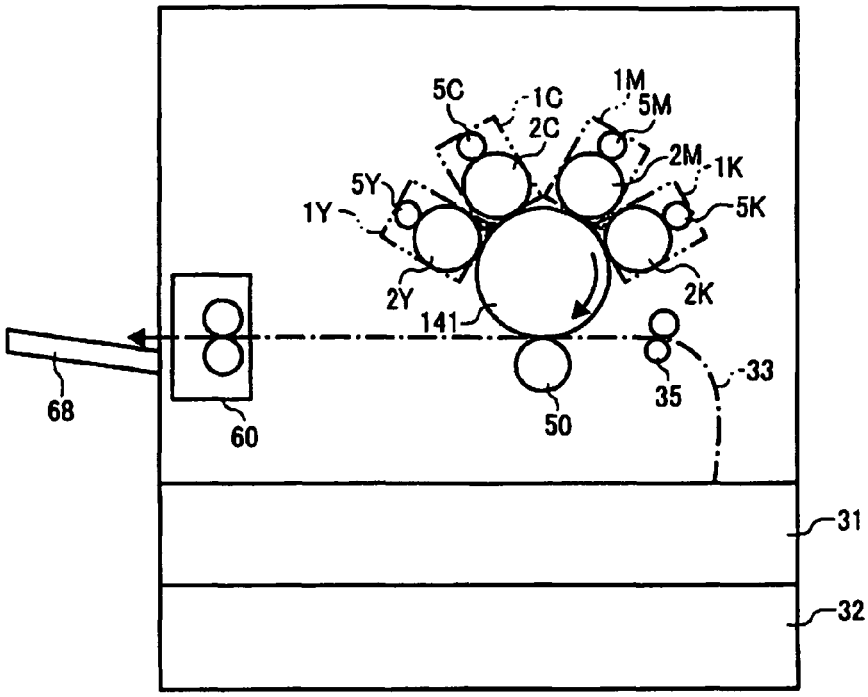
FIG. 16 is a schematic diagram of a color image forming apparatus that includes an intermediate transfer drum.
Figure 17:
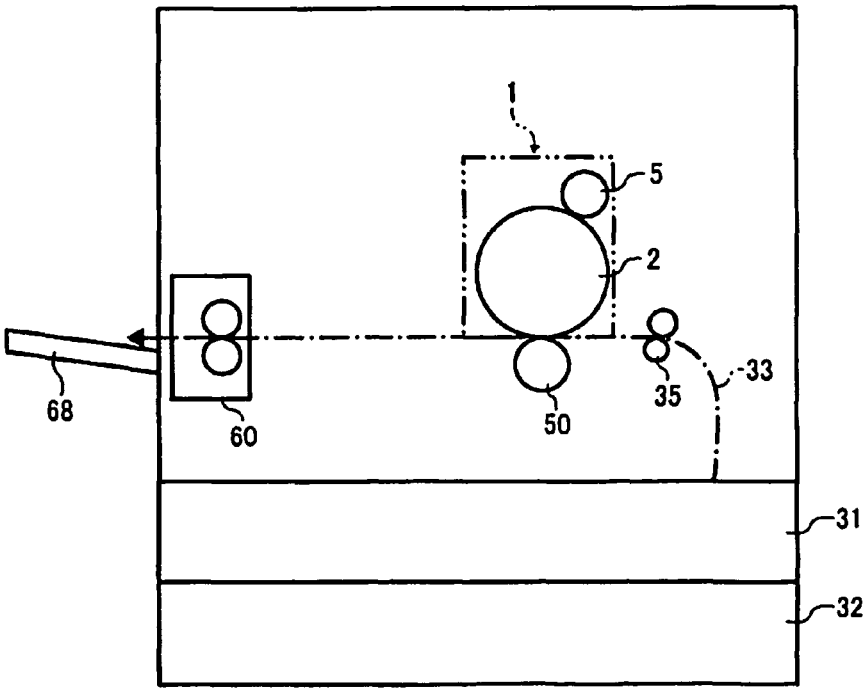
FIG. 17 is a schematic diagram of a monochromatic image forming apparatus.

Meanwhile, although the above description is given for a tandem-type color image forming apparatus having an intermediate transfer mechanism, the embodiment can also be implemented in other types of image forming apparatuses. For example, the embodiment can be implemented in a tandem-type color image forming apparatus having a direct transfer mechanism in which the intermediate transfer belt 41 is used (see FIG. 15), a color image forming apparatus in which a single intermediate transfer drum 141 (see FIG. 16) is used instead of the intermediate transfer belt 41, and a monochromatic image forming apparatus having a direct transfer mechanism in which an image formed on the photosensitive drum 2 is directly transferred on a recording medium at a nip formed between the photosensitive drum 2 and the secondary transfer roller 50 (see FIG. 17).

To sum up, the position of the process cartridge 1 with respect to the apparatus main-body is determined based on the drum shaft 2*a*. The female connector 71 is arranged on the rear end of the developing roller shaft 5*j*. One end of the female connector 71 is the cup-like portion 71*a*. The ring-like space 71*d* is formed between the outer ring 71K and the inner ring 71*c*. The track grooves (outer track grooves 71*e* or inner track grooves 71*f*) are equidistantly arranged on at least one of the outer ring 71K and the inner ring 71*c*. The male connector 72 enters into the ring-like space 71*d*, which is closed on the other side. The male connector 72 is arranged on the cartridge driving shaft 82 and includes the spherical-body holding portion 72*a* holding the spherical bodies 73. The cartridge driving shaft 82 is supported on the supporting plate 89. The end of the cartridge driving shaft 82 facing the process cartridge 1 is maintained movable in the radial direction.

Figure 22:
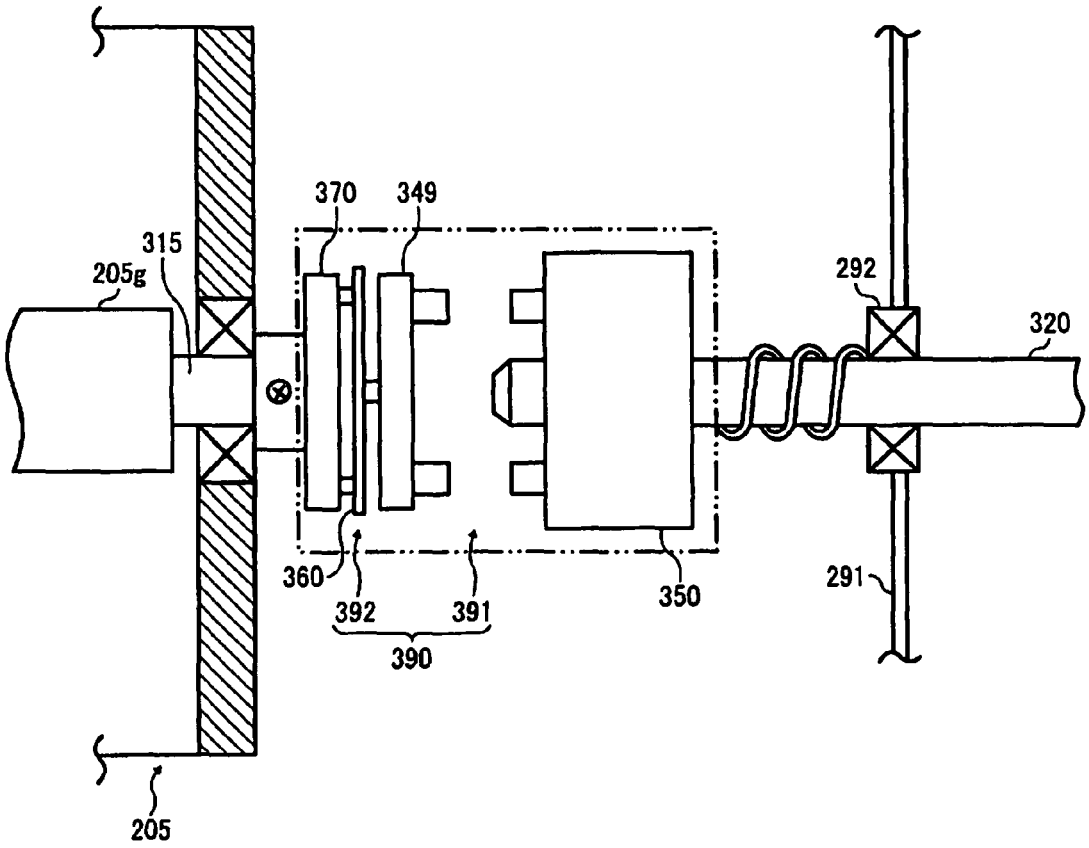
FIG. 22 is a diagram of a conventional coupling mechanism that includes a coupling joint and a tilt angle negating unit.

Meanwhile, the shaft centers of the developing roller shaft 5*j* and the cartridge driving shaft 82 are out of alignment, the cartridge driving shaft 82 tilts to get coupled with the developing roller shaft 5*j* via the constant-speed joint 70. At that time, the spherical-body holding portion 72*a* enters into the ring-like space 71*d* such that the spherical bodies 73 engage with the track grooves. As a result, the torque of the cartridge driving shaft 82 is properly transmitted to the developing roller shaft 5*j*. Even if the cartridge driving shaft 82 rotates with a tilt angle, the spherical bodies 73 perform back-and-forth sliding movement along the track grooves to negate any effect of speed fluctuation due to the tilt of the cartridge driving shaft 82. As a result, the developing roller shaft 5*j* and the developing roller 5*g* rotate at a constant speed thereby preventing variation in image density. Moreover, the number of constituent elements is reduced as compared to a conventional configuration (see FIG. 22). Thus, a simplified image processing apparatus can be manufactured at a low cost.

Furthermore, because the female connector 71 and the male connector 72 are made of a slidable resin material, the spherical bodies 73 can smoothly slide over the track grooves without greasing the ring-like space 71*d*. That reduces the operating noise as compared to a conventional metallic configuration.

Meanwhile, a slidable resin material can be used to manufacture only the spherical bodies 73 to maintain their slidability over the outer track grooves.

The spherical-body holding portion 72*a* enters into the ring-like space 71*d* after the position of the process cartridge 1 with respect to the apparatus main-body is determined along the radial direction. Such a configuration reduces the degree of misalignment in the female connector 71 and the male connector 72 in the radial direction as compared to a conventional configuration of determining the position of the process cartridge 1 with respect to the apparatus main-body after the spherical-body holding portion 72*a* enters into the ring-like space 71*d*.

The female connector 71 is arranged on the developing roller shaft 5*j* because of having less operating life than the male connector 72. Thus, it becomes easy to replace the female connector 71 when the process cartridge 1 is detached from the apparatus main-body. That improves maintainability of as compared to a case when the female connector 71 is arranged on the cartridge driving shaft 82.

The constant-speed joint 70 enables the developing roller 5*g* and the photosensitive drum 2 to rotate at a constant speed thereby preventing variation in image density.

The first pulley 86 is arranged on the driven shaft 94*b*, while the second pulley 83 is arranged on the cartridge driving shaft 82. The timing belt 85 is stretched around the first pulley 86 and the second pulley 83. Such a configuration enables the timing belt 85 to negate the tilt of the second pulley 83 when the cartridge driving shaft 82 tilts to get coupled and the developing roller shaft 5*j* couple. That prevents the constant-speed joint 70 from getting damaged as can be a case in a gear engagement mechanism. More particularly, if a gear engagement mechanism is used to couple the cartridge driving shaft 82 and the developing roller shaft 5*j*, then there is a possibility that the tilt of the cartridge driving shaft 82 causes damage to the teeth of the gears.

The shaft holding mechanism 87 holds the cartridge driving shaft 82 such that the end facing the process cartridge 1 is maintained movable in the radial direction. That helps in reducing the stress on the cartridge driving shaft 82 when it tilts to get coupled with the developing roller shaft 5*j*. Thus, the cartridge driving shaft 82 is prevented from deformation.

The cartridge driving shaft 82 is stably supported in the apparatus main-body because the shaft holding mechanism 87 elastically holds it.

The cartridge driving shaft 82 is stably supported in the apparatus main-body because the shaft holding mechanism 87 is made of a pliable material.

By rotatably clamping the cartridge driving shaft 82 to the supporting plate 89 after the process cartridge 1 is installed in the apparatus main-body, the amount of vibration generated due to the rotation of the cartridge driving shaft 82 can be curbed thereby preventing a traverse stripe effect in an image.

Thus, according to an aspect of the present invention, a driven shaft is coupled with a driving shaft by using a constant-speed joint. Such a configuration enables the driven shaft to rotate at a constant speed thereby preventing rotation fluctuation of a rotating member arranged on the driven shaft.

Moreover, because of the constant-speed joint, a simplified image forming apparatus can be manufactured at a low cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an apparatus main-body that includes a rotatable driving shaft rotated by a driving force of a driving source;

a processing unit that includes a rotatable driven shaft and a rotating member arranged on the driven shaft and that is configured to be detachably installed in the apparatus main-body;

a coupling mechanism that couples the driving shaft to the driven shaft, the coupling mechanism including a male connector being fixed on either one of the driving shaft and the driven shaft and a female connector being fixed on either one of the driving shaft and the driven shaft on which the male connector is not fixed; and a positioning mechanism that, when the processing unit is installed in the apparatus main-body, performs positioning of the processing unit with respect to the apparatus main-body, the positioning mechanism including a first positioning member in the apparatus main-body and a second positioning member in the processing unit and the first positioning member engages with the second positioning member when the processing unit is installed in the apparatus main-body thereby performing positioning of the processing unit with respect to the apparatus main-body, wherein an end of the driving shaft facing the processing unit is movable in directions orthogonal to the driving shaft, the female connector has an external wall and an internal wall forming therebetween an open-ended ring-like space, and includes a plurality of grooves that run in a direction of depth of the ring-like space on at least one of the external wall and the internal wall, the male connector includes a plurality of spherical bodies that, upon entering into the ring-like space, slide along the track grooves, and when the processing unit is installed in the apparatus main-body, the male connector is coupled with the female connector by inserting the spherical bodies in the ring-like space.

2. The image forming apparatus according to claim 1, wherein the male connector and the female connector are made of a slidable resin material.

3. The image forming apparatus according to claim 1, wherein the spherical bodies are made of a slidable resin material.

4. The image forming apparatus according to claim 1, wherein, after the processing unit performs positioning of the processing unit with respect to the apparatus main-body, a portion of the male connector is inserted into the ring-like space.

5. The image forming apparatus according to claim 1, wherein the female connector is arranged on the driven shaft and the male connector is arranged on the driving shaft.

6. The image forming apparatus according to claim 1, wherein the female connector is arranged on the driving shaft and the male connector is arranged on the driven shaft.

7. The image forming apparatus according to claim 1, wherein the processing unit is a process cartridge that includes an image carrying member and a developing member as the rotating member.

8. The image forming apparatus according to claim 7, wherein the apparatus main-body further includes an image-carrier driving shaft that transmits the driving force to the image carrying member;

a first pulley that is fixed to the image-carrier driving shaft;

a second pulley that is fixed to the driving shaft; and an endless belt that is stretched around the first pulley and the second pulley.

9. The image forming apparatus according to claim 1, wherein the apparatus main-body further includes a shaft holding mechanism that holds the driving shaft in a movable manner in the directions orthogonal to the driving shaft.

10. The image forming apparatus according to claim 9, wherein the shaft holding mechanism elastically holds the driving shaft.

11. The image forming apparatus according to claim 10, wherein the shaft holding mechanism is made of a pliable material.

12. The image forming apparatus according to claim 1, wherein the apparatus main-body further includes a clamping mechanism that, after the processing unit is installed in the apparatus main-body, clamps the driving shaft to the apparatus main-body in a rotatable manner.

* * * * *

UNITED STATES PATENT AND TRADEMARK OFFICE

CERTIFICATE OF CORRECTION

PATENT NO. : 7,822,364 B2
APPLICATION NO. : 12/219281
DATED : October 26, 2010
INVENTOR(S) : Junya Takigawa et al.

It is certified that error appears in the above-identified patent and that said Letters Patent is hereby corrected as shown below:

On the Title Page,
Please add the second assignee to the patent. The Assignee's should be as follows:

Item (73)
Ricoh Company, Limited
Tokyo, JAPAN

NTN Corporation
Osaka, JAPAN

Signed and Sealed this
Ninth Day of August, 2011

David J. Kappos

David J. Kappos
*Director of the United States Patent and Trademark Office*